US008818881B2

(12) United States Patent
Himmerick et al.

(10) Patent No.: US 8,818,881 B2
(45) Date of Patent: Aug. 26, 2014

(54) SYSTEM AND METHOD FOR INTEGRATING A PLURALITY OF ISOLATED COMPONENTS INTO AN ONLINE AUCTION FOR AUTOMATIC REAL-TIME AUCTION PARTICIPANT SUPPORT

(75) Inventors: Kyle Martin Himmerick, Longmont, CO (US); Todd Richard Kinzle, Longmont, CO (US); Andrew Marvin Welch, Longmont, CO (US)

(73) Assignee: Vauto, Inc., Oak Brook, IL (US)

( * ) Notice: Subject to any disclaimer, the term of this patent is extended or adjusted under 35 U.S.C. 154(b) by 387 days.

(21) Appl. No.: 13/110,792

(22) Filed: May 18, 2011

(65) Prior Publication Data

US 2012/0130843 A1 May 24, 2012

Related U.S. Application Data

(60) Provisional application No. 61/345,951, filed on May 18, 2010.

(51) Int. Cl.
*G06Q 30/00* (2012.01)

(52) U.S. Cl.
USPC ..... 705/26.3; 705/26.1; 705/27.1

(58) Field of Classification Search
USPC ..... 705/26.1–27.2, 26.3
See application file for complete search history.

(56) References Cited

U.S. PATENT DOCUMENTS

| | | | |
|---|---|---|---|
| 5,774,873 | A | 6/1998 | Berent et al. |
| 6,449,601 | B1 | 9/2002 | Friedland et al. |
| 6,610,936 | B2 | 8/2003 | Gillespie et al. |
| 6,813,612 | B1 | 11/2004 | Rabenold et al. |
| 7,107,543 | B2 | 9/2006 | Berry et al. |
| 7,113,853 | B2 | 9/2006 | Hecklinger |
| 7,219,080 | B1 | 5/2007 | Wagoner et al. |
| 7,284,002 | B2 | 10/2007 | Doss et al. |
| 7,596,512 | B1 | 9/2009 | Raines et al. |

(Continued)

OTHER PUBLICATIONS

Business Editors, a. H. (Jul. 29, 1999). Rbid.com, home of the Internet's supersite prepares for massive launch of its rHomeGuide, rAutoMall, and rFreeAds classifieds section. Business Wire. Retrieved from http://search.proquest.com/docview/446583464?accountid=14753.*

(Continued)

*Primary Examiner* — Kathleen G Palavecino
(74) *Attorney, Agent, or Firm* — Sutherland Asbill & Brennan LLP

(57) ABSTRACT

Disclosed is a method and system for integrating a plurality of isolated components to automatically provide real-time support to a participant in an online auction, particularly for live online auctions that may require quick decision making. An embodiment may automatically display information from the plurality of isolated components for the current item being auctioned in the online auction in a single user interface window. An embodiment may further update any information from any of the plurality of isolated components in real-time as the online auction is occurring. Examples of various isolated components that may be integrated into the single user interface window include: item history reports, third party valuation reports on the item, and the interface into the online auction. Various embodiments may have additional user interface windows concurrently monitoring/automatically integrating with different online auction locations that are concurrently auctioning different items. An embodiment may also include automatic non-decision support actions such as: requesting placing purchased items into an electronic inventory system, requesting delivery/shipping of purchased items, and/or requesting financing for a purchase.

36 Claims, 11 Drawing Sheets

(56) References Cited

U.S. PATENT DOCUMENTS

| | | | |
|---|---|---|---|
| 2005/0086070 | A1 | 4/2005 | Engelman |
| 2005/0119913 | A1 | 6/2005 | Hornreich et al. |
| 2005/0203824 | A1 | 9/2005 | Freud et al. |
| 2005/0267774 | A1 | 12/2005 | Merritt et al. |
| 2005/0278199 | A1 | 12/2005 | Ghani |
| 2006/0004646 | A1 | 1/2006 | Schoen et al. |
| 2006/0101139 | A1 | 5/2006 | Hornreich et al. |
| 2006/0122929 | A1 | 6/2006 | Schoen et al. |
| 2007/0100844 | A1 | 5/2007 | Buttner et al. |
| 2007/0203823 | A1 | 8/2007 | Whelchel et al. |
| 2007/0214074 | A1 | 9/2007 | Friedland et al. |
| 2007/0250327 | A1 | 10/2007 | Hedy |
| 2007/0293997 | A1 | 12/2007 | Couch |

OTHER PUBLICATIONS

International Search Report mailed Sep. 27, 2011, in PCT Application Serial No. PCT/US11/37037, filed May 18, 2011.

* cited by examiner

100 FLOW CHART OF OPERATION OF AN EMBODIMENT THAT INTEGRATES A PLURALITY OF ISOLATED COMPONENTS INTO AN AUCTION PARTICIPANT SUPPORT SYSTEM

200 TYPICAL ARCHITECTURE OF INTERNET ACCESSED ISOLATED (I.E., SEPARATE & INDEPENDENT) DATA PROVIDERS

AN EXAMPLE INSTANCE OF A SINGLE USER INTERFACE WINDOW FOR AN EMBODIMENT

400 DATA FLOW/ARCHITECTURE FOR NATIVE AUCTION WEB COMPONENT ACCESS TO AN ONLINE AUCTION SERVER

402 DATA FLOW/ARCHITECTURE FOR LOCAL LOG FILE/DATABASE ACCESS TO AN ONLINE AUCTION SERVER

404 DATA FLOW/ARCHITECTURE FOR LOCAL NON-WEB AUCTION APPLICATION ACCESS TO AN ONLINE AUCTION SERVER

406 DATA FLOW/ARCHITECTURE FOR DIRECT ACCESS TO AN ONLINE AUCTION SERVER

500 TYPICAL CLIENT/SERVER ARCHITECTURE FOR A WEB COMPONENT ENABLED APPLICATION COMPONENT

600 AN EVENT HANDLING ARCHITECTURE TO HANDLE EVENTS DELIVERED TO ISOLATED COMPONENTS OF AN EMBODIMENT

WEB PAGE ARCHITECTURE FOR AN EVENT HANDLER SYSTEM OF AN EMBODIMENT

800 AN EMBODIMENT HAVING A COMPONENT THAT AUTOMATICALLY DISPLAYS A VEHICLE VALUE DURING A ONLINE AUCTION

SYSTEM AND METHOD FOR INTEGRATING A PLURALITY OF ISOLATED COMPONENTS INTO AN ONLINE AUCTION FOR AUTOMATIC REAL-TIME AUCTION PARTICIPANT SUPPORT

CROSS REFERENCE TO RELATED APPLICATIONS

This application is based upon and claims priority to U.S. provisional application Ser. No. 61/345,951, filed May 18, 2010, entitled "System and Method for Integrating a Plurality of Components into a Live Auction for Automatic Real-Time Auction Participant Support," all of which is specifically incorporated herein by reference for all that it discloses and teaches.

BACKGROUND OF THE INVENTION

Every year millions of items are bought and sold at live auctions. Live auctions remain a popular way to buy and sell many types of items, including vehicles, real-estate, equipment, artwork and cattle. The fast pace of auctions is a part of their culture and an important part of their efficiency. In many cases, auctioneers spend less than one minute on items worth tens of thousands of dollars. This pace requires auction participants to be well prepared and well informed to participate in the auction or risk making costly mistakes. Buyers may research a myriad of types of information for each item of interest at an auction, such as: item history, item specifications, item condition, comparable retail values, comparable wholesale values, market supply and market demand. This research can take a significant amount of time to collect for a single item and is magnified by the number of items of interest to an auction participant. Since the preparation to properly inform an auction participant on each item in the auction may exceed the time of execution of the auction itself, the auction participant often must choose between participating with less than the desired research information on each item, or the auction participant must skip a significant number of items being auctioned.

In recent years, auction houses have enabled auction participants to participate in live auctions electronically, both on site and remotely. With the ability to participate remotely through electronic means, live auctions participants now have access to multiple locations and auction lanes simultaneously. In vehicle auctions, a "lane" is a separate live auction which may be held at the same location as other auctions (i.e., lanes), but in a different traffic lane such that multiple live auctions may occur at the same time. With multiple locations that may each have multiple lanes, the number of concurrent live auctions that may be of interest to an auction participant could number in the tens or even hundreds. While this greatly increases the number of items buyers and sellers can participate in—they are still necessarily limited by the amount of preparation time it takes to be adequately prepared for so many items.

SUMMARY OF THE INVENTION

An embodiment of the present invention may comprise a method for integrating a plurality of isolated components operating on a computer system into an auction participant support system operating on the computer system in order to provide automatic real-time support for an auction participant user comprising: selecting the plurality of isolated components operating on the computer system by a user of the auction participant support system operating on the computer system such that at least one of the plurality of isolated components is an online auction application component that permits the auction participant user to participate in an online auction, the online auction application component being directed to a first online auction; configuring attributes and display of the plurality of isolated components for a single auction item within a single user interface window of the auction participant support system by the auction participant user; obtaining identification information by the auction participant support system operating on the computer system that identifies a current auction item that is currently being auctioned in the online auction from the online auction application component; delivering the identification information that identifies the current auction item being auctioned from the auction participant support system to the plurality of isolated components except the online auction application component; prompting each of the plurality of isolated components to update information for each of the plurality of isolated components based on the identification information that identifies the current auction item being auctioned; and displaying the updated information for the current auction item from the plurality of isolated components in the single user interface window of the auction participant support system such that the auction participant user obtains auction decision support information for the current auction item from the plurality of isolated components in the single interface window of the auction participant support system.

The embodiment of the method for integrating a plurality of isolated components into an auction participant support system may further comprise monitoring the online auction application component for changes/actions occurring in the online auction by the auction participant support system operating on the computer system; delivering change/action information regarding the changes/actions occurring in the online auction from the auction participant support system to the plurality of isolated components except the online auction application component; prompting each of the plurality of isolated components to update information for each of the plurality of isolated components based on the change/action information; and displaying the updated information based on the change/action information in the single user interface window of the auction participant support system.

An embodiment of the present invention may further comprise an auction participant support system for integrating a plurality of isolated components operating on a computer in order to provide automatic real-time support for an auction participant user comprising: a component selection subsystem that selects the plurality of isolated components operating on the computer system at direction of the auction participant user such that at least one of the plurality of isolated components is an online auction application component that permits a user to participate in an online auction, the online auction application component being directed to a first online auction; a component configuration subsystem that configures attributes and display of the plurality of isolated components for a single auction item within a single user interface window of the auction participant support system at direction of the auction participant user; a current auction item identification subsystem that obtains identification information that identifies a current auction item that is currently being auctioned in the online auction from the online auction application component and delivers the identification information that identifies the current auction item being auctioned to the plurality of isolated components except the online auction application component; an update component subsystem that prompts each of the plurality of isolated components to update information for each of the plurality of isolated components based on the identification information that identifies the current auction item being auctioned; and a user interface subsystem that displays the updated information for the current auction item from the plurality of isolated components in the single user interface window such that the auction participant user obtains auction decision support information for the current auction item from the plurality of isolated components in the single interface window.

The embodiment of the auction participant support system for integrating a plurality of isolated components may further comprise an auction monitoring subsystem that monitors the online auction application component for changes/actions occurring in the online auction and delivers change/action information regarding the changes/actions occurring in the online auction from the auction participant support system to the plurality of isolated components except the online auction application component; wherein the update component subsystem prompts each of the plurality of isolated components to update information for each of the plurality of isolated components based on the change/action information; and wherein the user interface subsystem displays the updated information based on the change/action information in the single user interface window of the auction participant support system.

An embodiment of the present invention may further comprise an auction participant support system for integrating a plurality of isolated components operating on a computer in order to provide automatic real-time support for an auction participant user comprising: means for selecting the plurality of isolated components operating on the computer system by a user of the auction participant support system operating on the computer system such that at least one of the plurality of isolated components is an online auction application component that permits the auction participant user to participate in an online auction, the online auction application component being directed to a first online auction; means for configuring attributes and display of the plurality of isolated components for a single auction item within a single user interface window of the auction participant support system by the auction participant user; means for obtaining identification information by the auction participant support system operating on the computer system that identifies a current auction item that is currently being auctioned in the online auction from the online auction application component; means for delivering the identification information that identifies the current auction item being auctioned from the auction participant support system to the plurality of isolated components except the online auction application component; means for prompting each of the plurality of isolated components to update information for each of the plurality of isolated components based on the identification information that identifies the current auction item being auctioned; and means for displaying the updated information for the current auction item from the plurality of isolated components in the single user interface window of the auction participant support system such that the auction participant user obtains auction decision support information for the current auction item from the plurality of isolated components in the single interface window of the auction participant support system.

BRIEF DESCRIPTION OF THE DRAWINGS

In the drawings,

FIG. 4A is a schematic illustration of data flow and the general data communication architecture for native auction web component access of an online auction server for an embodiment.

FIG. 4B is a schematic illustration of data flow and the general data communication architecture for log file/database access of an online auction server for an embodiment.

FIG. 4C is a schematic illustration of data flow and the general data communication architecture for local non-web auction application access of an online auction server for an embodiment.

FIG. 4D is a schematic illustration of data flow and the general data communication architecture for direct access of an online auction server for an embodiment.

DETAILED DESCRIPTION OF THE EMBODIMENTS

Figure 1:
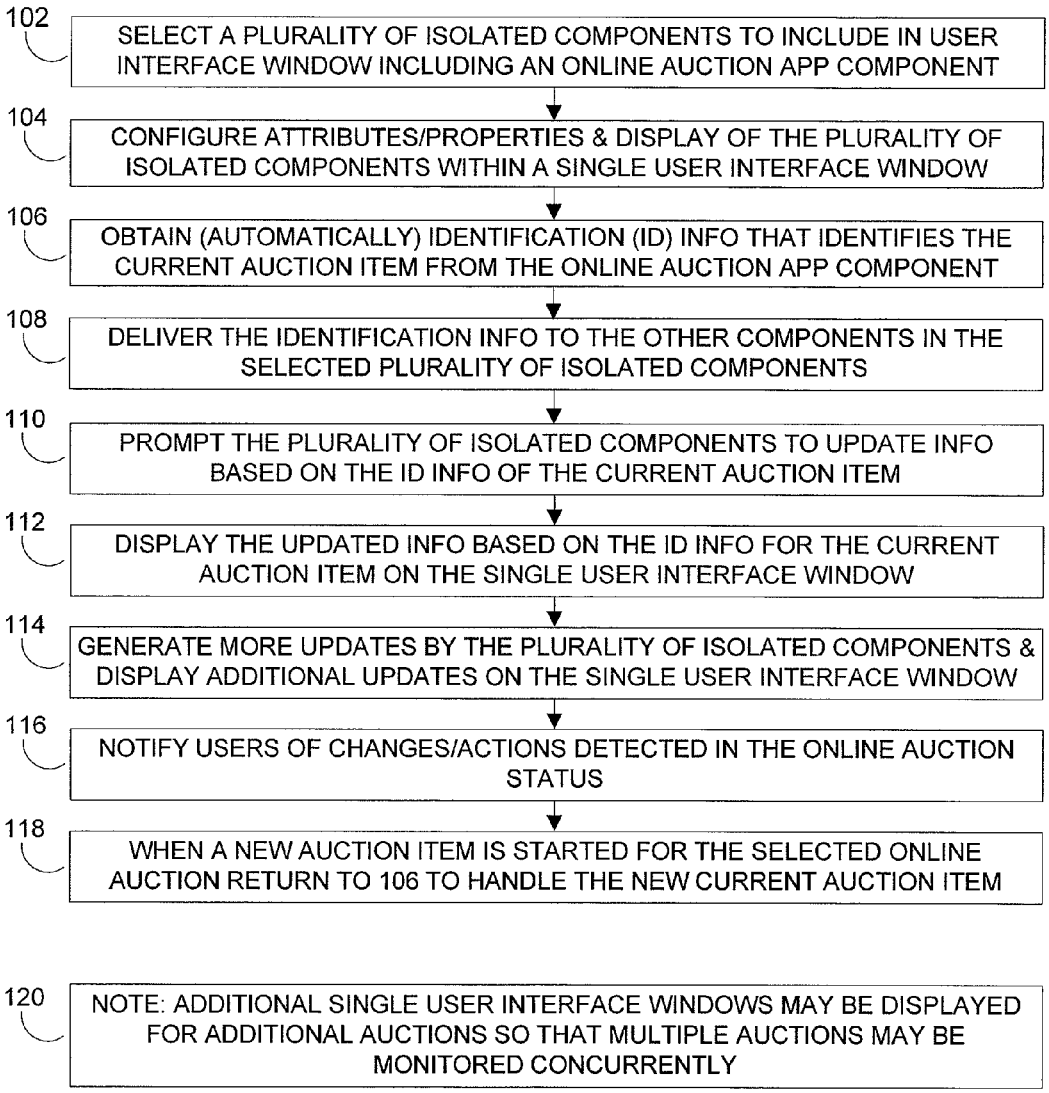
FIG. 1 is a flow chart of the operation of an embodiment that integrates a plurality of isolated components into an auction support system.

Participants in online live auctions often must take an inordinate amount of time to properly prepare background information about items to be auctioned in order to participate in the online live auction with confidence. A typical buyer looks to obtain a quality item at a price that is competitive in the marketplace. If the buyer is a dealer/reseller, the buyer likely intends to resell the item to the public and the quality/price necessarily needs to allow for a markup in order to provide profit to the dealer in the overall transaction. A seller wants the maximum value attainable for the item and seeks to avoid taking amounts less than comparable values in the marketplace, where the marketplace is a comparable auction (wholesale value) that accounts for the potential to add a markup for resale to the general public by a dealer. The issue of taking a large amount of time researching, organizing and preparing background information on each auction item prior to a live auction is amplified by professional buyers (such as product dealers) that participate in numerous live auctions each year, and often wish to participate in multiple auctions in a single day, and maybe even concurrently (i.e., at the same time). The time to properly research, organize and prepare background information on items to be auctioned often limits the number of items and/or the number of auctions the auction participant (e.g., dealer) may participate in during a year and/or concurrently occurring live auctions. Further, if an auction participant running low on time chooses to participate without doing the necessary background research on the auction items, the auction participant may make mistakes that could be costly depending on the amount overpaid for an auction item, or the opportunity lost if the auction participant does not recognize a bargain price and misses bidding for a bargain item. Online static/non-live auctions, such as a typical eBay® auction, may have similar research and preparation demands as an online live auction, but in a static/non-live auction, an auction participant may have ample time to perform the necessary research and preparation without significant impact on the choice to participate in the various online static/non-live auctions. Even though an online static/non-live auction may permit a user more time to do research on items up for bid that does not necessarily mean that an auction participant in a static/non-live auction "wants" to spend more time preparing. Thus, while particularly well suited to the real-time demands of an online live auction, an auction participant in a static/non-live auction may also benefit in time savings by having access to an embodiment of an auction participant support system as disclosed herein. Since the disclosed embodiments of the auction participant support system may be particularly applicable for a live auction, examples disclosed herein may specifically identify a live auction, but one skilled in the art will recognize that the disclosed embodiments of the auction participant support system may also be applied to a static/non-live online auction even though the real-time nature of the disclosed embodiments may not be needed for the static/non-live auction. Further, when referring herein to an auction as simply an "online auction," it is intended that the "online auction" include both live online auctions and static/non-live online auctions.

The system and method disclosed herein provides support for an auction participant in order to supply the important information relevant to an item being auctioned at an online live auction in real-time during the live auction in a single, configurable user interface window for each auction item (as noted above, the various embodiments may also be beneficially utilized by online static/non-live auction participants). Thus, an embodiment may present an auction participant with a "self organized" research system that automatically and in real-time provides the auction participant the information desired (i.e., configured to display) by the user in the single user interface window. The single, configurable user interface window is "self organized" because auction participants configure which data to display and where the data is displayed on the single user interface window. The data is automatically updated for each auction item and organized on the screen as configured/desired by the auction participant. Further, data may also be automatically updated on the occurrence of other auction changes/activities such as, but not limited to: auction start, auction end, new bids, new minimum/asking price, sale, conditional sale, no-sale, watch item, etc. An auction participant user may configure the single user interface window by selecting particular isolated components and configuring the display of the plurality of isolated components on the single user interface window. Both buyer and seller auction participants may benefit from the use of the "self organized" user interface window. Clearly, a buyer benefits from the instant, automatic, and organized access to data about auction items presented in real-time such that the buyer is able to make quick and informed buying decisions without the need to do preparatory background research. A seller benefits by being able to quickly and easily track sales in an auction and/or other similar concurrently occurring auctions to determine whether it would be beneficial to raise or lower the minimum/asking price on an auction item in real-time, while the auction(s) is taking place. An auction facilitator (i.e., the entity operating the auction) may also benefit from the ability to view additional data on auction items as the items are auctioned to ensure that the auction is run properly and legally.

The single user interface window may be configured to integrate a plurality of isolated components. Each of the isolated components may provide a separate and distinct set of application functionality. Some of the isolated components may have a visual representation and allow the user to interact with the isolated component contained in the single user interface window. Some components may not have a visual representation and may instead provide only background services or actions. The auction participant support system may allow isolated components to define dependencies between components so components may leverage shared services. When a component is included in the auction participant support system, the component may become an observer of the online auction and all of the activity related to the online auction. Depending on the desired purpose of the isolated component, the isolated component may watch or listen for certain/specific events to occur in the online auction. When the specific events of interest happen, the isolated component may then dictate what and how the isolated component reacts to the specific event of interest. For example, some isolated components may be designed to listen for a "new item" event, and will gather and display information about the new item in response to the new item event. Other components may progressively collect summary data and display updated totals after each auction item outcome event. Still other isolated components may be designed to perform background actions such as importing a purchased item into an inventory system and the like. Isolated components may receive events in real-time such as, but not limited to events for: auction start, auction end, new bids, new minimum/asking price, sale, conditional sale, no-sale, watch item, etc. Components may also perform one or more of the example functions discussed above in a single component.

Since some/all isolated components may be provided by a third-party without an implicit trust relationship, the application framework may provide security isolation between components (commonly referred to as 'sandboxing'). The "sandboxing" security measure ensures that components do not maliciously or inadvertently interfere with other isolated components. One of the isolated components may be an online auction application component. The online auction application component may provide the electronic means for an auction participant user to participate in the online auction (e.g. place a bid, approve a sale). The online auction application component may be treated in the same manner as any other isolated component (sandboxing, layout) but is a necessary component for participation in an online auction. Unlike other isolated components, the online auction application component may not be closed or removed from the auction participant support system. Without the online auction component the user may lose the ability to interact with the auction, and other isolated components would not be able to observe auction related events.

An embodiment may provide an Application Programming Interface (API) for users to create additional components as desired by the users. Some of the isolated components may also permit the auction participant user to enter/perform information/instructions from the user such as entering bids on auction items, selecting a specific type of report, etc. Some of the isolated components may encapsulate an application that is a client of a server application. The server application may be connected locally or remotely over a network connection such as an Internet connection. An isolated component may instruct the remote server application, either operating locally or remotely over a network connection on a separate computer system, to deliver information to the isolated component.

An embodiment of the auction participant support system may obtain identification information about the current auction item from the online auction application component and deliver that information to the remaining isolated components. The remaining isolated components may update information based on the identification of the current auction item. The information update regarding the current auction item happens in real-time during the online auction as each item is brought up for auction. Additional updates may also occur automatically and in real-time to one or more of the isolated components based on the occurrence of auction changes/activities such as, but not limited to: auction start, auction end, new bids, new minimum/asking price, sale, conditional sale, no-sale, watch item, etc. The information about the current auction item obtained from each isolated component may then be displayed at the same time in the single user interface window to permit the auction participant to view complete, thorough and organized information about the current auction item in real-time during the online (and perhaps live) auction without the need to prepare background information by researching and organizing information about each auction item prior to the online auction. Thus, an auction participant may quickly and easily participate in an online auction with complete and thorough information about each item being auctioned with no, or reduced, preparatory background research (often colloquially referred to as homework). The information is displayed to the auction participant in real-time, permitting the auction participant to make bids on auction items with confidence that the bids are going to result in a purchase of a quality item at a good price in the same manner as if the auction participant had spent the time prior to a live online auction to perform background research on the auction item. Any updates of information from the isolated components that occur during the auction may be updated on the single user interface window so as to communicate the updates to the auction participant in real-time. For instance, the online auction application component may update for each new bid on an auction item and/or at the start/end of the auction for an auction item. The auction participant support system may automatically update the plurality of isolated components when a new item is put up for auction at a live online auction.

If multiple live auctions (i.e., a plurality of live auctions) are occurring concurrently, multiple user interface windows (i.e., a plurality of single user interface windows) may be created with each single user interface window reflecting information about the current auction item for each live auction. The auction participant may monitor and/or participate in the multiple auctions by switching between the single user interface windows as desired. The plurality of single user interface windows may be opened as separate new windows (i.e., popup windows) or the single user interface windows may be included as "tabbed" windows within a master window, where each tab displays one of the plurality of single user interface windows. An embodiment may also combine tabbed windows with separate new windows as desired/configured by the auction participant user.

To assist the auction participant, the auction participant support system and/or one or more of the plurality of isolated components may issue a notification when changes and/or actions are occurring in an online auction, such as, but not limited to: the start of an auction for a new auction item, the end of an auction for an auction item, when a new bid is received for the current auction item, a new asking price is received for the current auction item, the current auction item is sold, the current auction item is sold conditionally, a no-sale of the current auction item, and/or a specifically desired auction item on a watch list is brought up for auction. A more sophisticated isolated component may watch for particular lanes/auctions that are consistently resulting in sales that are a good deal, according to criteria established by the auction participant user and/or isolated component designer, and issue a notification to the auction participant user. Another type of watch list may watch for particular types of items, such as watching for all corvettes coming up to auction, or perhaps all corvettes of a range of model years in a particular price range. A watch list based on the general attributes of the items up for auction may "watch" for items based on one or more of the available auction items attributes, such as make, model, mileage, model year, color, etc. for a motor vehicle. Various embodiments may build a list of keywords for each vehicle (i.e., each auction item) that comes across an auction block, and then compare the list of keywords for each vehicle/auction item to the keyword and structured criteria the user previously defined for the watch list (or a user defined "shopping list"). If all of the keywords (e.g., model name, make, etc.) and the structured criteria (e.g., year, mileage, condition, etc.) are satisfied by the current vehicle/auction item, then the vehicle/auction item may be highlighted and the user notified by visual and/or auditory cues.

A notification may be issued only when a single user interface window is considered the foreground (i.e., active) window, and/or when the single user interface window is in the background (i.e., not considered the currently active window). The single user interface window issuing the notification may be in the background to another single user interface window. Two effective real-time notification types include a visual cue and an audio cue. Visual cue notification may be a flashing color on the single user interface window, a change to the color/flashing color of a title bar, or any other visually observable cue to a user. An auditory cue may be the playing of a simple short sound or could actually be synthesized speech making a specific statement regarding the notification. If the notification is to be communicated when the single user interface is in the background, part of the notification may be to automatically switch the notifying single user interface to the foreground (i.e., active) window. However, automatically switching the single user interface from the background to the foreground/active window may be confusing to the user as well as having inherent risks that the user does not realize the foreground/active window has changed and either mistakenly believes the data is for a different auction and/or mistakenly takes an action on the single user interface switched to the foreground/active window that was meant for the previous foreground/active window. Hence, the choice to automatically switch the foreground focus is up to a system designer given the inherent tradeoff of clearly and quickly showing the item causing a notification versus the inherent risk in switching the focus of the user interface without receiving a direct command from a user for the change. Notification when windows are in the background may be especially helpful when an auction participant is monitoring/participating in multiple, concurrent live auctions so that the auction participant is made aware of changes in a background auction even while actively monitoring a different auction in a foreground single user interface window. A visual notification on an inactive window may be very helpful to an auction participant user to quickly locate the window with the "notifying" activity, where an audible only notification may make it difficult for the auction participant user to locate which window originated the notification. A combination of a visual and auditory cue may provide both a "wake-up" auditory cue and a visual indication of which window generated the notification. Further, a watch list permits the auction participant user to identify specific auction items of interest to the auction participant by maintaining a list of watched items. Notification when watch list items are brought up for bid (i.e., auction is started on a watch list item) allows the auction participant to work on other matters until the desired auction item is brought up for bid, which may be particularly helpful when the notifying single user interface window is in the background.

The auction participant support system may be configured by a user to include a plurality of desired isolated components. The auction participant may be provided a list of available components to select from for inclusion in the auction participant support system. Some of the separate and independent isolated components may provide decision support information. Each of the decision support isolated components may be integrated together to display information regarding a current auction item on the single user interface window. Rather than simply focusing on specific items of interest, some isolated components may collect and display summary data, such as, but not limited to: total sales, auction efficiency, participant statistics, suspicious activity, sales trends, etc. Some of the separate and independent isolated components may be non-decision support components that provide automatic actions such as, but not limited to: importing purchased items as a new inventory item within an inventory system accessible by the computer system running the auction participant support system, requesting delivery/shipping of said purchased items in accord with preferences of the auction participant user, request a post-sale inspection of a purchased auction item, requesting financing to complete a purchase of auction items, resolving conditional sales, completing/negotiating a title release for an auction item (such as a title to an automobile/vehicle), and/or maintaining a budget or inventory distribution. Non-decision support components may be integrated into the system without any visual display of the non-decision support function on the single user interface window. However, if necessary or desired, appropriate status, action buttons, etc. may be shown on the single user interface window for any non-decision support isolated components selected and configured by the auction participant user. Where and how data is displayed on the single user interface window may be configured by the auction participant user. Further, the auction participant user may add and/or remove isolated components as desired. Configuring the isolated components may include visually dragging and sizing the display in the single user interface window and/or updating configuration information available in a pop up window containing information specific to a particular isolated component. Example preferences may include user name and password information which may be necessary to obtain particular reports. Also, it may be desirable to configure whether to automatically request reports or to wait for a user to specifically request a report if each report costs money. By permitting a user to select from various isolated components, an auction participant user is able to configure the auction participant support system to meet the individual needs and preferences of the auction participant support user. Selection from various isolated components also permits auction participant users to use information reports, services, and/or any other isolated components from different vendors such that one auction participant user may use data/services from a first vendor while another auction participant may use similar data/services from a second vendor, while both auction participant users utilize the same, configurable auction participant system.

Various embodiments may monitor the online auction application component for changes/actions such as, but not limited to: the start of an auction for a new auction item, the end of an auction for an auction item, when a new bid is received for the current auction item, a new asking price is received for the current auction item, the current auction item is sold, the current auction item is sold conditionally, a no-sale of the current auction item, and/or a specifically desired auction item on a watch list is brought up for auction. The various embodiments may deliver change/action information regarding the monitored changes/actions in the online auction application component to the remaining plurality of isolated components. The delivery of the change/action information to the isolated components may prompt/trigger one or more of the isolated components to update information for the one or more isolated components. The prompt to update may come in a variety of forms capable of causing an isolated component to update information. For instance, an embodiment of an isolated component may be prompted to update information when the isolated component receives/detects a particular event message indicating a particular change/action in the online auction. Another embodiment may issue a command/instruction to the isolated components to update all or a portion of information when a particular change/action in the online auction is detected. Each of the isolated components may individually be designed to update some or all information for a limited subset of specified auction changes/actions. Thus, each isolated component may quickly ignore and avoid further processing for unspecified auction changes/actions while still updating some or all information in accord with the desired update for one or more particularly specified auction changes/actions. An isolated component designer may specify the desired updates or lack of updates (i.e., filtering) for particular types of auction changes/actions. Once the isolated component has been prompted to update information, the updated information for the one or more isolated components may be displayed to the auction participant in the single user interface window.

An embodiment may optimize processing by scaling down data retrieval when a single user interface window has been placed in the background (i.e., the single user interface is not the current primary foreground/active window). For instance, video and/or audio feeds to the auction may be suspended when a single user interface window is no longer the primary active/foreground window. Also, automatic retrieval of value, history, or other reports may be suspended while the single user interface is in the background, particularly if the reports have a monetary cost for requesting the report that may be avoided when the user is not actively interacting with the single user interface window. Auction changes/events may still be monitored in order to permit the background single user interface window to issue notifications (audio and/or visual cues) of changes in the auction being monitored by the single user interface window. Also, isolated components may be notified when the isolated components should be "enabled" or "disabled," and the notified isolated components may change operational behavior, accordingly. A "disable" notification may be due to the parent/owner single user interface window going inactive (i.e., going to the background) or the notified isolated component being minimized. An "enable" notification may be sent to one or more components when the parent/owner single user interface window becomes active or the notified component is restored from a minimization. Various embodiments may also enable components if a "watched" item is brought up as the active auction item. Various embodiments may also bring an auction with a "watched" item to the foreground of the window, but embodiments may simply give some audio or visual cue of a "watched" item rather than changing the focus of the user interface that may disturb a system user. Some isolated components may not want to change behavior at all in response to "enable/disable" notifications. For example, an auction summary component may wish to continue collecting data even though the parent/owner single user interface window is not active.

An embodiment may provide one or more isolated components that act as information gatherers. The information gatherer components may use the identification information of the current item to collect and store additional details/information about the current auction item. For instance, in a vehicle auction the online auction application component may only deliver the Vehicle Identification Number (VIN) while one or more isolated components may require the make and model. Rather than having each isolated component individually retrieve the additional item information (e.g., the make and model based on the VIN for a vehicle), a single isolated component (i.e., an additional item information gatherer component) may retrieve the additional item information and pass that additional item information to the one or more other isolated components that need the additional item information for the current auction item. In some embodiments, to help with communication efficiencies, the additional information gatherer component may notify components that additional information is available and limit sending the additional information to only the isolated components that "access" the additional information (i.e., an "accessor" model). The "accessor" model has some additional advantages beyond purely making the communications more efficient, such as, but not limited to when at least one component is "enabled" from a "disabled" state (as described above), the at least one "enabled" component may use the additional information gatherer component to quickly get the details about the current item, even though "enabled" component may have been asleep when the additional information about the current auction item arrived at the additional information gatherer component. Further, some embodiments may have "dependencies" between components such that one component is dependent on another component to obtain particular data. The "dependencies" may further be chained such that a first component provides data to a second, dependent component, which, in turn, provides data to a third component that is "dependent" on both the first component and the second component.

Various embodiments may communicate between the isolated components operating on a computer system and/or the auction participant support system operating on the computer system by issuing event messages and/or listening for the event messages in order to react to appropriate events. Each of the isolated components may filter event messages such that only specified/desired events/event types cause the individual isolated component to react (e.g., prompt the isolated component to update information). Further, embodiments of isolated components may employ a publish and subscribe system where event message streams from the other isolated components and/or the auction participant support system are published by the event message issuer and only other isolated components and/or the auction participant support system subscribing to the event message stream will receive/listen for the messages. Thus, isolated components that do not subscribe to a particular event message stream will not receive, and will not have to filter out, event messages in the unsubscribed message stream.

Various embodiments of an auction participant support system may be used for a variety of types of electronically accessible online auctions. Examples of types of auctions include, but are not limited to: automobile auctions, farm equipment auctions, construction equipment auctions, recreational vehicle auctions, motorcycle auctions, all-terrain vehicle auctions, motorized vehicle auctions, boat auctions, airplane auctions, motorized equipment auctions, industrial equipment auctions, cattle auctions, horse auctions, livestock auctions, art auctions, and general merchandise auctions. The identification information obtained from the online auction application component for the current auction item and delivered to the remaining isolated components may be, but is not limited to: VIN, make, manufacturer, model, sub-model, trim package, model year, manufacture/build date, engine size, mileage, included equipment/options, operational hours, location, acreage, number of buildings, building descriptions, age, breed, sex, artist, options added, and options removed.

When addressing examples of online auctions, the remainder of this paper typically selects a default auction type of an automobile/vehicle auction. The selection of an automobile/vehicle auction as the example auction type is not meant to be limiting and the concepts, features, and technology disclosed herein may be applied by one skilled in the art to various types of online auctions in similar fashion as applied to the example vehicle auction. In the example of an online vehicle auction, each individual auction is typically held in a "lane." Thus a single online vehicle auction may be referred to as a "lane" and a plurality of vehicle auctions may be concurrently held in multiple "lanes." Every year millions of vehicles are bought and sold at auctions by dealers. When a vehicle is up for bid at an auction, the vehicle is typically on the auction block for one minute or less. Vehicles are inherently hard to value, have different specifications, conditions and a market that is always changing. Further, there are a wide range of information sources available for buyers to evaluate vehicle values, histories and conditions; but the evaluation with the available information sources can be a time consuming task, particularly when evaluating numerous vehicles. Many buyers simply rely on their instincts and emotions to make important buying decisions, which may result in costly mistakes and lost opportunities. Embodiments of the auction support system permit buyers (and sellers) to have real-time access to a wide variety of decision support information from a wide variety of vendors. Embodiments may permit multiple decision support sources from multiple decision support vendors to be displayed in a single user interface window. The single user interface window may integrate the online auction and the decision support data from a plurality of isolated components into the single user interface window and be automatically updated in real-time to reflect information about the current item being auctioned. Some decision support components may include, but are not limited to: vehicle history reports, vehicle valuations, comparable retail values of vehicles, vehicle condition reports, and an auction participant's own dealer management information. Vehicle history reports may be provided by commercial vendors such as CARFAX® or AutoCheck. Vehicle valuations may be provided by commercial vendors such as Kelley Blue Book® (KBB), Manheim Market Report (MMR), National Automobile Dealers Association (NADA) reports, vAuto™, eCarList®, and/or Black Book®. Comparable retail/used/wholesale values may be provided by commercial vendors such as AutoTrader.com®, Cars.com™, and/or Google Base™. Further, comparable values may be filtered by one or more of date, location, seller, etc. Vehicle condition reports may be provided by a general condition report service provider, a dealer side provider associated with the online auction provider, and/or reports produced by third parties such as AUTOVIN® or Alliance Inspection Management (AiM). Dealer management information may include, but is not limited to: an available budget report, an inventory mix goal/report, and/or a specific shopping list of desired vehicles. Additional isolated components for non-decision support may include, but are not limited to: post-sale inspection requests, transportation of purchased vehicles (either from the auction provider or an external dispatcher), purchase payment, purchase financing (i.e., vehicle flooring), conditional sale resolution, and/or import vehicle purchase information into the inventory system of the dealer. The non-decision support functions may also be performed in real-time so that post-sale purchase decisions and inventory tracking may be updated/requested immediately at the time of sale.

The auction participant support system disclosed herein provides an auction participant with the information that the auction participant needs at their fingertips with little, if any, researching effort. For example, when a new car/vehicle comes onto the auction block, the single user interface window for the auction may automatically display a vehicle history report, recent comparable wholesale transactions, the condition report of the vehicle, and comparable retail listings of similar vehicles. With the integrated information, the buyer/auction participant may make an informed bid/no-bid decision on each and every vehicle with little, if any, preparation time for the auction. Since preparation time is significantly reduced, buyers/auction participants may participate in more auctions while still making better informed purchase decisions.

Various embodiments of an auction participant support system may communicate what is happening in the auction through a messaging system. Depending on the type of computer system the participant is using, different techniques may be used to relay messages. A computer system may be a typical personal computer, a mainframe, or other general purpose computer system. The computer system may also be embodied as a computing device that is a dedicated computing device specific for the purpose of interaction with auction, which may be hand held, desktop, fixed emplacement, or otherwise made available to an auction participant. Component applications may listen for certain types of events and react to the events as the events happen in real-time. For example, when a new vehicle is announced on the auction block, various components may automatically retrieve information for that new vehicle. In addition, since the auction participant support system has knowledge of changes/actions occurring at the auction, as the changes/actions happen, additional services may also be provided to auction participants. For instance, an inventory component may automatically import purchases into a Dealer Management System as the purchases occur.

FIG. 1 is a flow chart 100 of the operation of an embodiment that integrates a plurality of isolated components into an auction support system. At step 102, the auction participant user selects a plurality of isolated components to include the single user interface window for an online auction. One of the selected components may be an online auction application component that permits the user to participate in an online auction. For car/vehicle auctions, "Simulcast" provided by Manheim.com™ and "LiveBlock™" by ADESA are examples of two popular live online auction applications that may be integrated with other isolated components providing additional decision support and/or non-decision support functionality. At step 104, the auction participant user configures attributes/properties and display characteristics (i.e., "natural" display characteristics such as screen location, sizing, visibility, etc.) of the selected plurality of isolated components for use within a single user interface window. At step 106, the identification information for the current auction item is automatically obtained from the online auction application component. As described above, the identification information may include one or more pieces of data capable of identifying the current item being auctioned. At step 108, the identification information is delivered to the isolated components except for the online auction application component that was the origin of the identification information of the current auction item in step 106. At step 110, each of the plurality of isolated components is prompted to update information based on the identification information for the current item being auctioned. The delivery of the identification information to the isolated components may prompt/trigger the isolated components to update information. The prompt to update may come in a variety of forms capable of causing an isolated component to update information. For instance, an embodiment of an isolated component may be prompted to update information when the isolated component receives/detects an event message indicating a new auction item and containing identification information regarding the new auction item in the online auction. Another embodiment may issue a command/instruction to the isolated components to update all or a portion of information concurrently with or after delivering the current auction identification information to the isolated components.

At step 112, the updated information based on the identification information of the current auction item is displayed in the single user interface window. At step 114, the plurality of isolated components may generate additional updates to information and the additional updates may then be automatically displayed to the auction participant user in the single user interface window for the auction. Additional updates to the information in the plurality of isolated components may be the result of the isolated components reacting to changes/actions in the online auction (i.e., auction start, auction end, new bids, new minimum/asking price, sale, conditional sale, no-sale, watch item, etc.) and/or other circumstances that generate updated information as determined by each isolated component. At step 116, the auction participant user may be notified of changes/actions detected in the online auction status such as, but not limited to: start of an auction for an item, end of auction for an item, start of an auction for a watched item, end of an auction for a watched item, a no-sale for an auction item, a new asking price is received for a current auction item, the current auction item is sold, the current auction item is sold conditionally, etc. Typical notification techniques include visual and/or audio cues. Notifications may be issued when the single user interface window is in the foreground (i.e., the active window) or in the background (i.e., not the currently active window). Notification may be turned on and off, and/or configured to filter for particular changes/actions as well as foreground versus background status of the single user interface window according to the desires of the auction participant user. At step 118, when a new auction item is started for the online auction application component, the system returns to step 106 and updates the system/single user interface window for the new current auction item. As a practical matter, it may be wise to clear all isolated component data in the plurality of isolated components after step 118 to ensure that old data is not accidentally displayed when the system returns to step 106.

Note 120, indicates that multiple (i.e., a plurality of) concurrent auctions may be monitored by a corresponding plurality of single user interface windows configured to monitor each of the concurrent auctions. The functions described in steps 102-118 and in note 120 may be performed on a computer system with a display screen capable of interacting with the auction participant user. The isolated components may operate on the same computer system. However, the isolated components may also be clients to remote servers and/or other remote systems needed to obtain the necessary information. Thus, while the isolated components operate on the computer system, the isolated components may each communicate data and/or commands with remote servers/other applications over network connections (e.g., the Internet) such that the remote server/other applications operate on remote computer systems.

Figure 2:
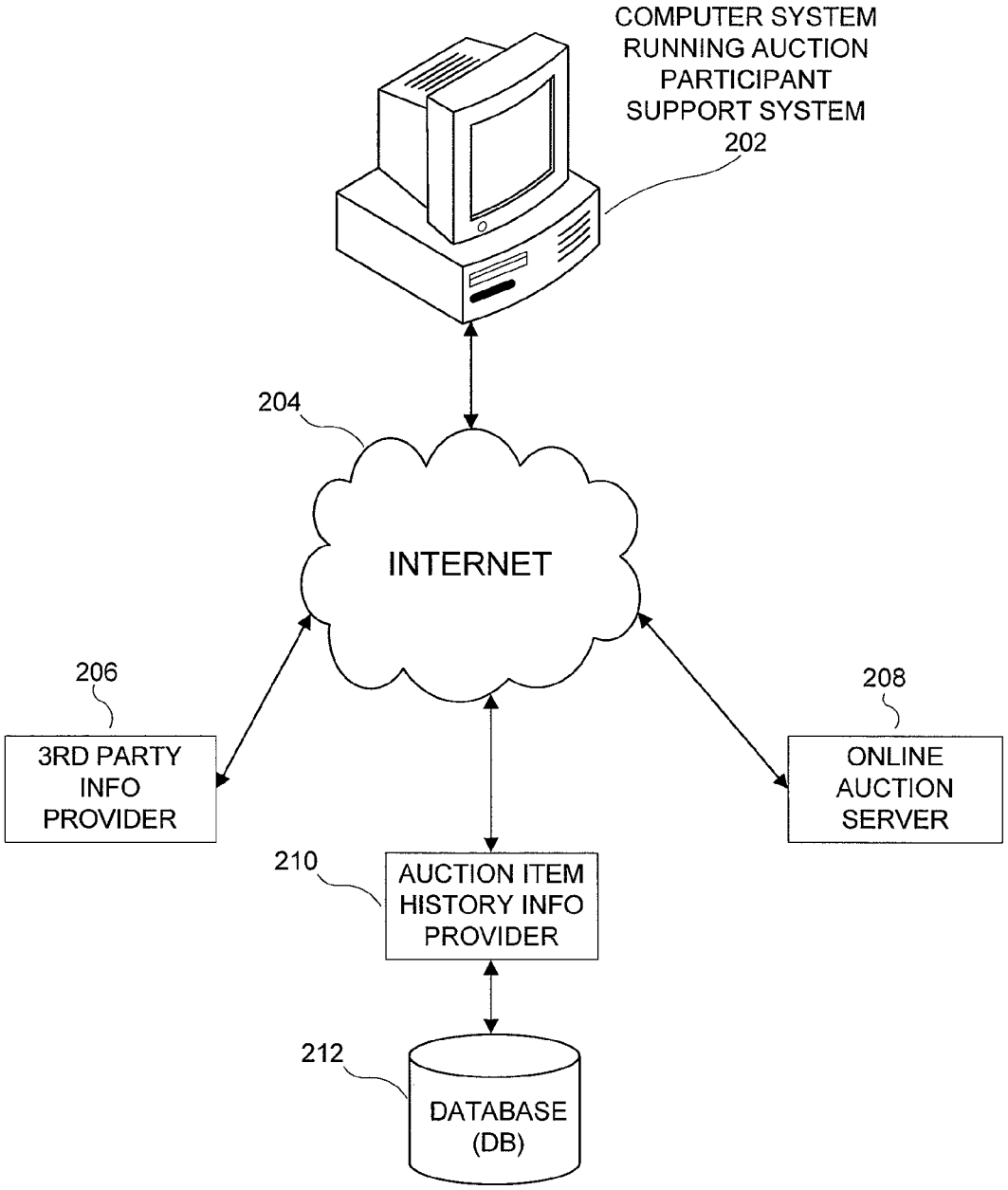
FIG. 2 is a schematic illustration of a typical architecture of Internet accessed isolated data providers.

FIG. 2 is a schematic illustration 200 of a typical architecture of Internet accessed isolated (i.e., separate and independent) data providers. In the embodiment 200 shown in FIG. 2, a computer system running the auction participant support system 202 may have a plurality of isolated components. The plurality of isolated components may access the Internet 204 to remotely obtain requested information from a server or other application (206, 208, 210) remotely connected via the Internet 204. In the embodiment shown in FIG. 2, the online auction server 208 running remotely provides information about the online auction over the Internet 204 to the online auction application component running on the computer system 202. The separate and independent auction item historical information provider 210 is also connected to the computer system 202 via the Internet 204. Further, the auction item historical information provider is also connected to a database 212 that may contain historical information on various items that may be put up for auction. For example, the database 212 may hold historical information on vehicles for a vehicle/car auction such as accident/repair histories or other historical data of interest. Other third party information providers 206 may also be connected to the computer system 202 via the Internet 204. The example system shown in FIG. 2 has only three information providers (206, 208, 210), but embodiments may have fewer or many more information providers. The third party information provider 206 may be set up to be accessed through a proxy server when needed to meet security requirements or restrictions. A proxy server may reside on either the client or server side, or both, as desired/required by system designers to perform relaying of communication messaging and to properly implement network security. For some third party information providers 206, there may be multiple layers of servers and systems that provide the end result data. For instance, a reformat service at a second server might reformat data provided by a first server into a particular report format before the data is delivered to the computer system running the auction participant support system 202. The third party information provider 206 may or may not access data in a database depending on the type of data being provided by the third party information provider 206, but it is likely that a database would be necessary for historical and/or non-calculated types of data. The information providers 206, 208 and 210 may be running on separate computer systems. All clients, servers, databases, and other functions may all run on a single computer system, but notably, that is not necessary.

Figure 3:
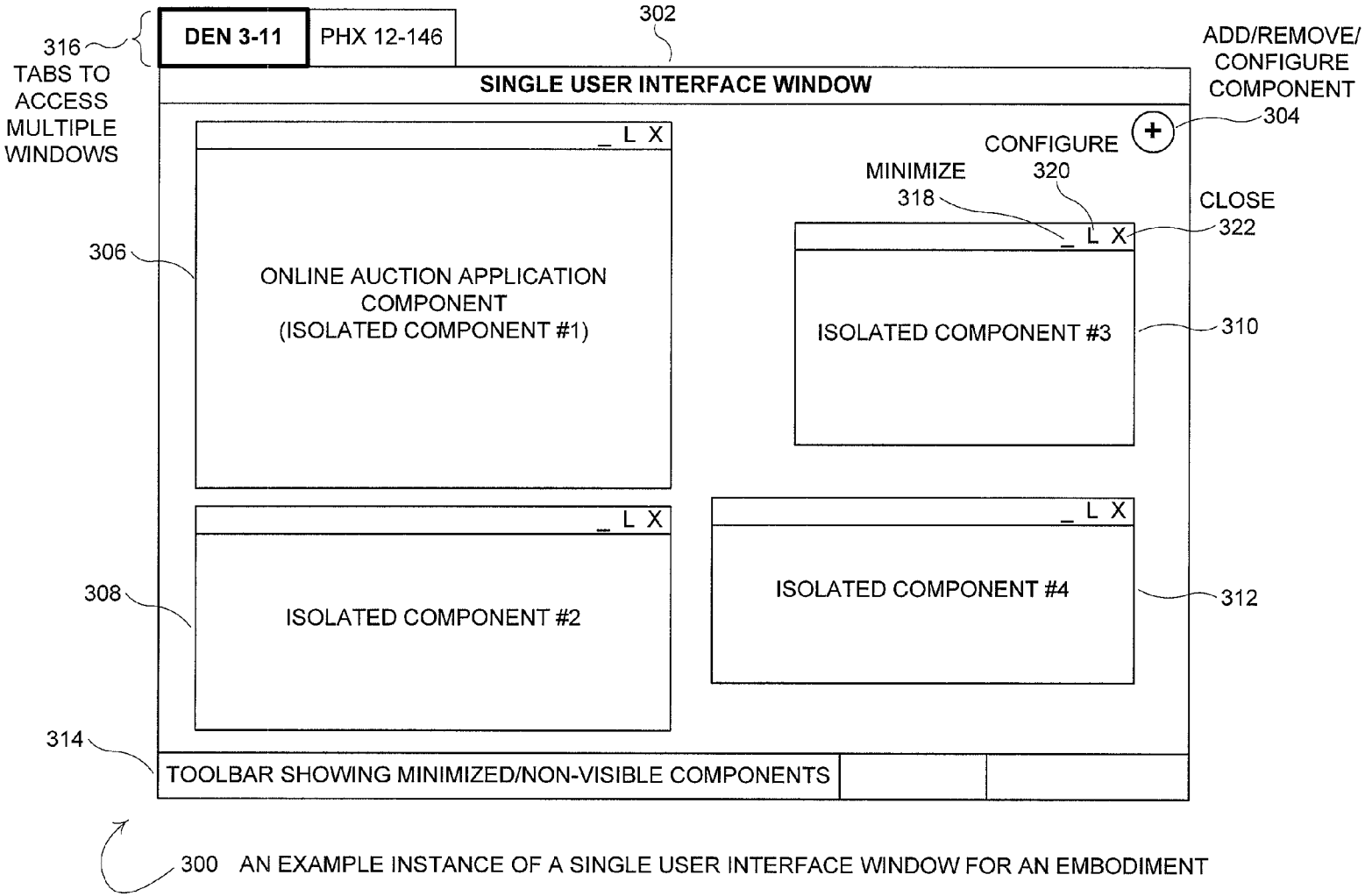
FIG. 3 is a schematic illustration of an example single user interface window for an embodiment.

FIG. 3 is a schematic illustration 300 of an example single user interface window for an embodiment. In the embodiment 300 shown in FIG. 3, the single user interface window 302 has four isolated components 306-312 displayed within the single user interface window 302. The online auction application component 306 (aka. isolated component #1) has been configured to appear in the upper left hand corner of the single user interface window 302. A second isolated component 308 has been configured to appear in the lower left hand corner of the single user interface window 302. A third isolated component 310 has been configured to appear in the mid to upper right hand corner of the single user interface window 302. A fourth isolated component 312 has been configured to appear in the lower right hand corner of the single user interface window 302. A button/icon 304 has been provided on the single user interface window to provide access for a user to add, remove, or configure/re-configure the plurality of isolated components 306-312. The button/icon 304 may also provide access to an "application store" where a user may add (and purchase if necessary) additional components 306-312 that the user wishes to have shown/running in an embodiment of the auction participant support system. When adding additional 306-312 there may be initial configuration of the component (including information such as passwords for remote server access, etc. as well as the basic configuration of the look and feel of added components 306-312).

Some embodiments may not include the add/remove/configure button 304, or may only include access to a subset of the options through the button 304. For instance, where individual components 306-312 provide separate configuration access 320, access to configuration may not be made available through the general add/remove button 304. Some embodiments may include access to "natural" configuration of the display of isolated components 306-312 by supplying minimize 318, configure 320, and close 322 buttons for each of the isolated components 306-312 as for the embodiment shown in FIG. 3. To provide for "natural" configuration, when the configuration button 320 is selected, a user may be permitted to configure the selected isolated component 306-312 by graphically repositioning (i.e., moving) and/or resizing the display of the selected isolated component 306-312, and when completed have the reconfiguration saved (i.e., stick or automatically saved) for future accesses of the single user interface window 302. The close button 322 may be used to close an isolated component 306-312 to avoid unnecessary processing if the information provided by an isolated component 306-312 is no longer desired. When an isolated component 306-312 is minimized by the minimize button 318, an icon or other indication of the minimized component may appear in the toolbar 314. Further, non-visible components (e.g., the non-decision support components without visible data and/or the additional item information gatherer components discussed in more detail above) may be indicated by an icon or other indication in the toolbar 314 in addition to indications for minimized isolated components 306-312.

The embodiment shown in FIG. 3 also shows a "tabbed" style of access to multiple instances of the single user interface window 302 where each instance of the single user interface window provides access to a separate concurrently occurring auction as discussed in more detail above. Each tab 316 represents a separate instance of a single user interface window 302. In FIG. 3, the active/foreground single user interface window tab 316 titled "DEN 3-11" represents the Denver auction, lane 3, run 11, and the background tab 316 titled "PHX 12-146" represents the Phoenix auction, lane 12, run 146 (not currently displayed since the DEN 3-11 window is in the foreground).

An embodiment may provide a "Component Store" to select and/or buy additional components. Further, an API may be provided/offered for sale to permit a user, software vendor, or other party to create additional components desired by users. A settings/preferences popup dialog box/window may be displayed to a user for the user to fill out to configure each of the isolated components 306-312. Potential settings for each isolated component 306-312 include, but are not limited to: title, description, category, dependent components (i.e., other components required for the desired component to function properly), visible status (on/off), default size (width, height), default position (x, y), price, and billing type (once, monthly, per-transaction, free, etc.). Display information (size, position) may be set by graphically configuring the isolated components 306-312 on the single user interface window 302 and/or may be entered as text in a popup dialog box (or any other data entry form desired by a system designer). Preferences for individual components may also be entered in the same dialog box, or in an additional popup dialog box. Typically, preferences are configured per component 306-312 and regard information that is specific to each component 306-312, such as user name, password, report type (full, partial, etc.), various user settings, and/or other data pertinent to a component 306-312.

FIGS. 4A-D are schematic illustrations 400-406 of data flow and the general data communication architecture for accessing an online auction server 414 for various embodiments. The online auction application component 410 of the auction participant support system 408 provides access to, display, and/or monitoring of the online auction server 414 for online auctions being participated in by a user of the auction participant support system 408. Depending on the capabilities of the technology provided by the online auction, data flow 416 to and from the online auction server may be implemented in various ways, such as the example data flow/architectures shown in the schematic illustrations 400-406 of FIGS. 4A-D. Regardless of how data is sent to and retrieved from the online auction server 414, ultimately, the online auction application component necessarily communicates the necessary data display and auction management from/to the online auction server 414. The actual technology utilized for data communication 416 is dependent on what the interface the online auction technology chosen by the online auction permits. Whatever communication data flow and communication architecture is implemented, the online auction application component 410 abstracts the implementation such that a user of the auction participant support system 408 is unaware of the background operation of the data communications and simply observes and manages the online auction through the online auction application component 410 of the auction participant support system 408. Four possible types of data flow and general data communication are discussed below and illustrated in FIGS. 4A-D.

Figure 4A:
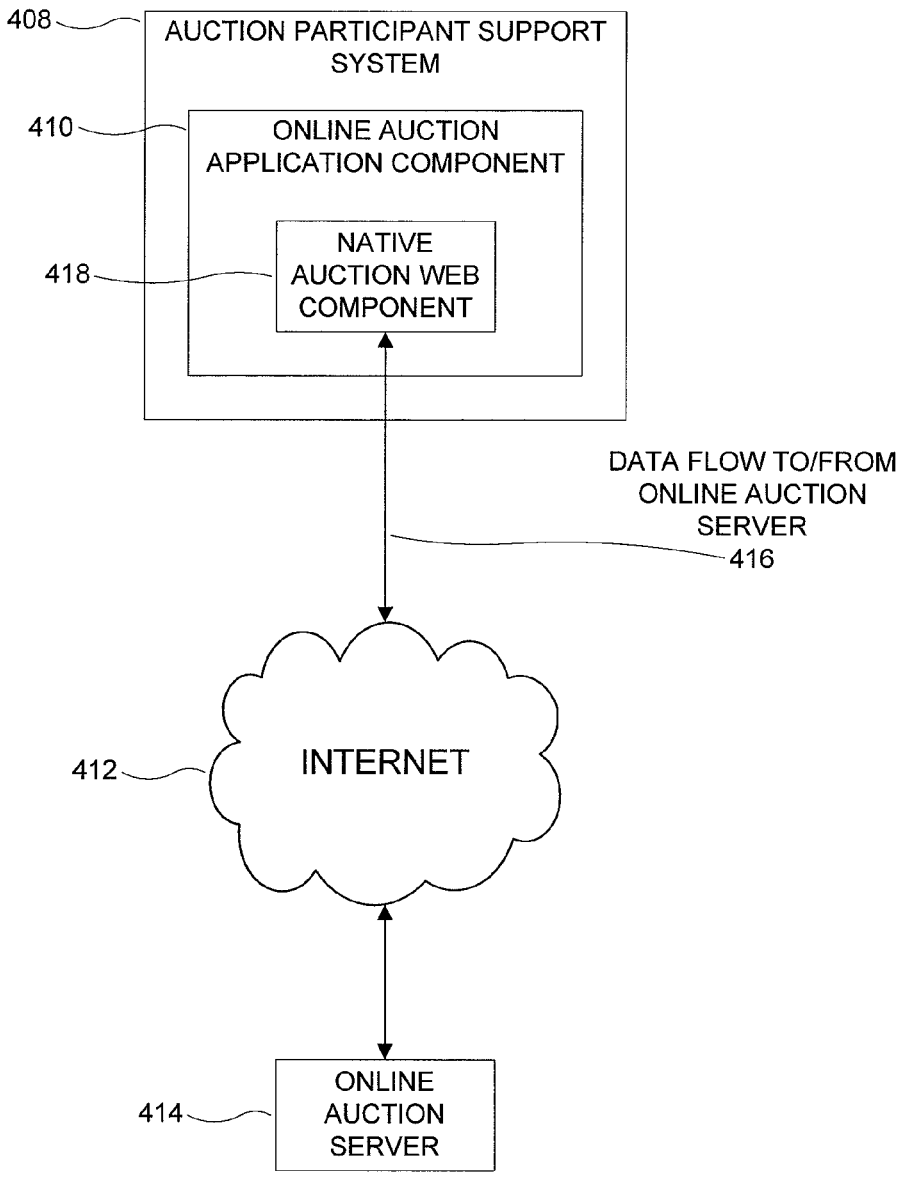
FIGS. 4A-4D are schematic illustrations of data flow and the general data communication architecture for accessing an online auction server for various embodiments.

FIG. 4A is a schematic illustration 400 of data flow and the general data communication architecture for native auction web component 418 access of an online auction server 414 for an embodiment. Further details of having a native auction web component is also disclosed below in the disclosure with respect to FIGS. 5-7. However, communication of events monitored by other means (i.e., the examples disclosed with respect to FIGS. 4B-D below) in the online auction application component 410 may also be communicated to the other isolated components of the system using similar event handling interfaces as used for the native auction web component 418. In FIG. 4A, the native auction web component 418, which is a web component of a native auction application running on the local computer system, manages the data flow 416 to/from the online auction server 414. The data flow 416 to/from the online auction server 414 is transmitted to/from the local system over the Internet (or other networking technology) from/to the online auction server 414.

Figure 4B:
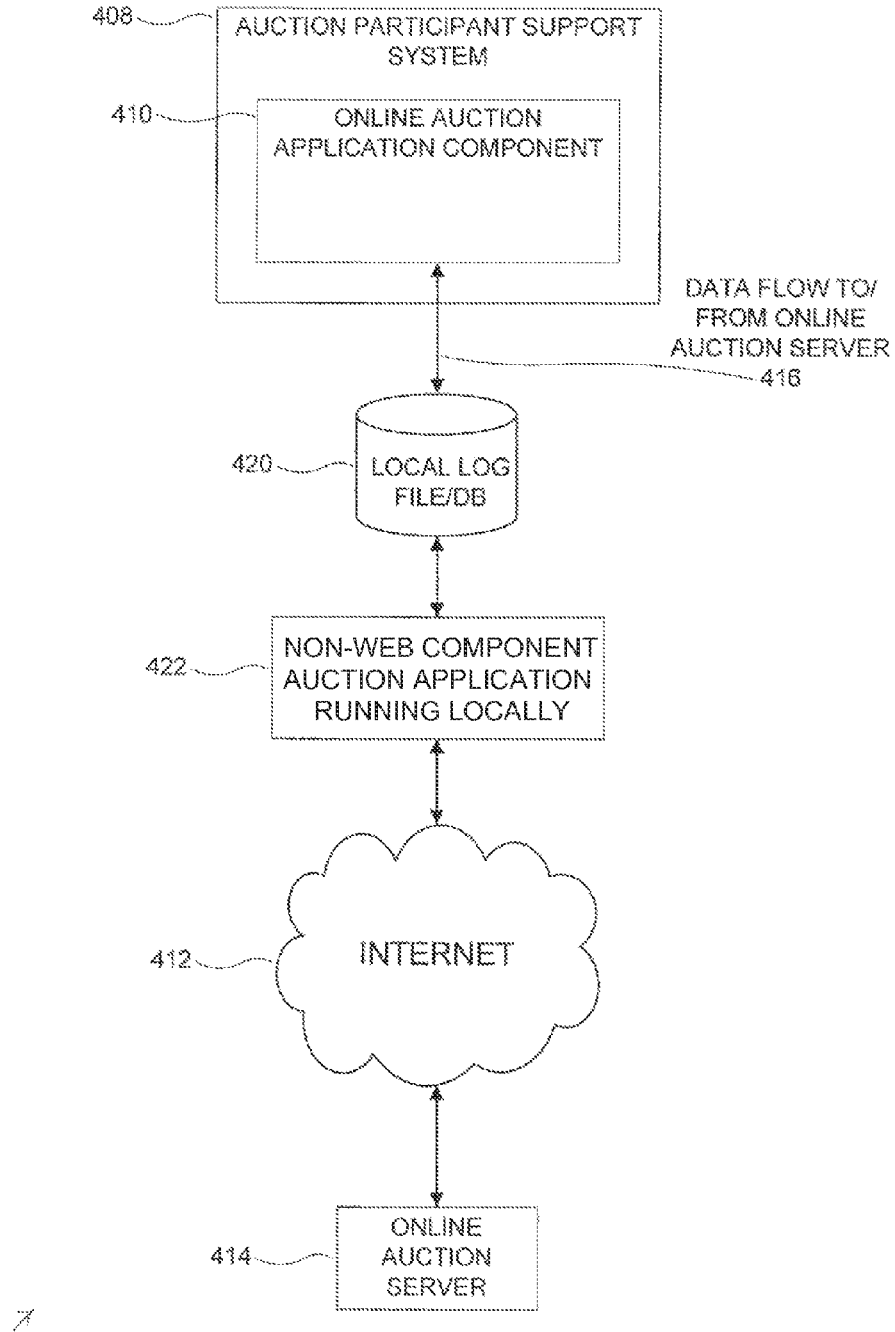

FIG. 4B is a schematic illustration 402 of data flow and the general data communication architecture for log file/database 420 access of an online auction server 414 for an embodiment. For some online auction servers 414, a web component of the native application may not be available so another means of communication may be needed to implement data flow 416 to/from the online auction server 414. In the embodiment shown in FIG. 4B, the native auction web component 418 is not available, but a non-web component auction application 422 may be running locally on the same computer system as the auction participant support system 408. Further, the non-web component auction application 422 may have a logging capability that permits the online auction application component 410 to read the log 420 produced by the non-web component auction application 422 such that the data flow 416 is accomplished via the log 420. The log 420 may be implemented as an electronic data file on a local computer readable media (e.g., a local hard disk drive). The log 420 may also be implemented using any locally stored recording system, including standard database (DB) systems. If the non-web component auction application 422 also reads from the log 420, commands may be sent to the online auction server 414 via the log 420 communication path. Sending data to the online auction server 414 via the log file 420 may not be supported, in which case, the system may need to implement a separate data flow path 416 for sending data to the online auction server 414, such as using some type of application interface (e.g., an Application Programming Interface (API) to send commands through the non-web component auction application 422 as described in the disclosure with respect to FIG. 4C below, and/or some type of direct communication with the online auction server 414 as described in the disclosure with respect to FIG. 4D below. Various embodiments may mix and match the technologies necessary to provide the desired data flow 416 communication between the online auction application component 410 and the online auction server 414. A JavaScript or other programmatic interface capable of providing data to/from the online auction application component 410 may be used to implement the monitoring of, reading from, and/or writing to the log file/database 420. Once again, the data flow 416 to/from the online auction server 414 is transmitted to/from the local system over the Internet (or other networking technology) from/to the online auction server 414.

Figure 4C:
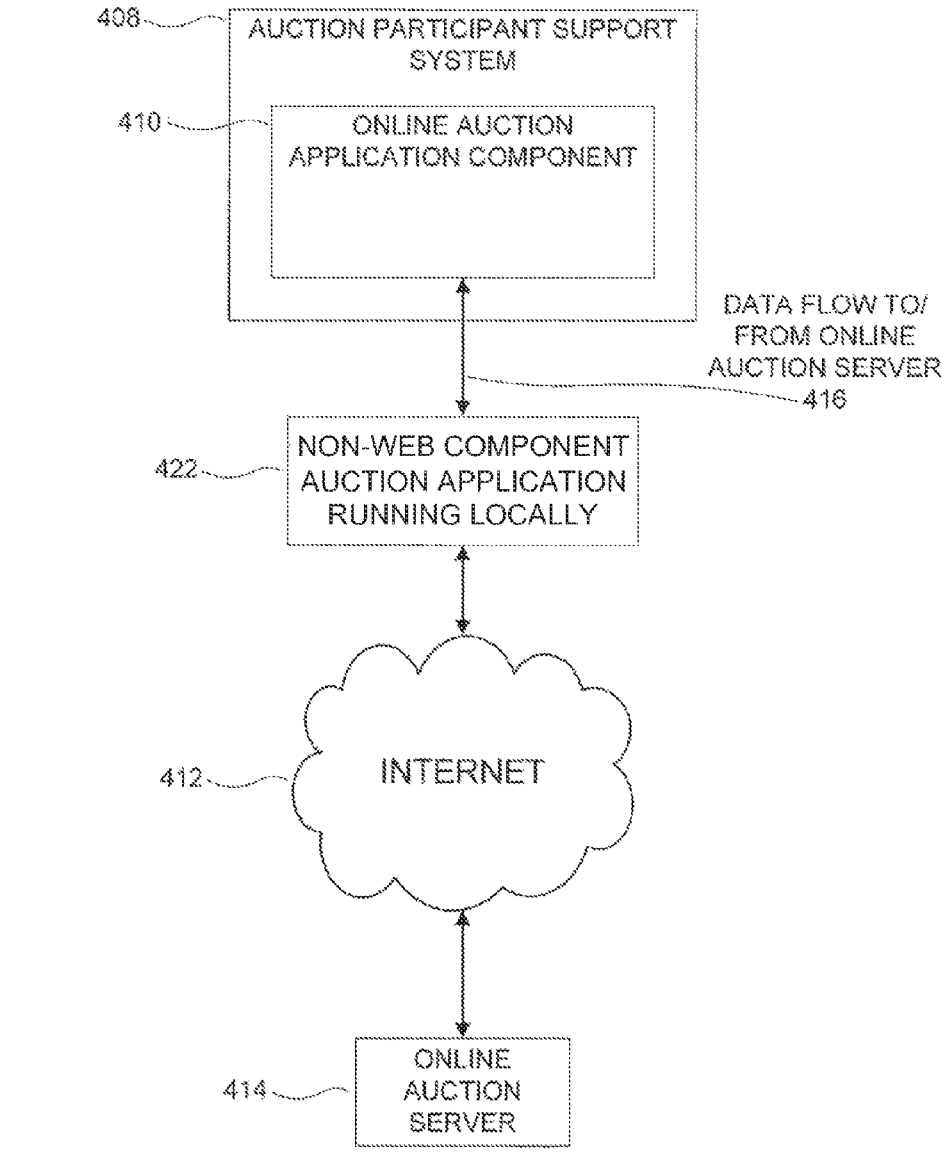

FIG. 4C is a schematic illustration 404 of data flow and the general data communication architecture for local non-web component auction application 422 access of an online auction server 414 for an embodiment. The data flow 416 for the embodiment shown in FIG. 4C is similar to the data flow 416 described in the disclosure with respect to FIG. 4B, except the log file/database 420 is not used (unless the embodiment is a hybrid system using the log file/database 420 for some communications and a programmatic interface to the non-web component auction application 422 for other communications). A JavaScript or other programmatic interface capable of providing the necessary data communications may be implemented for the online auction application component 410 to implement the monitoring of, reading from, and/or writing to the online auction server 414 through the locally running non-web component auction application 422. In some cases an Application Programming Interface (API) may be provided by the online auction provider to facilitate the necessary data flow 416. Once again, the data flow 416 to/from the online auction server 414 is transmitted to/from the local system over the Internet 412 (or other networking technology) from/to the online auction server 414.

Figure 4D:
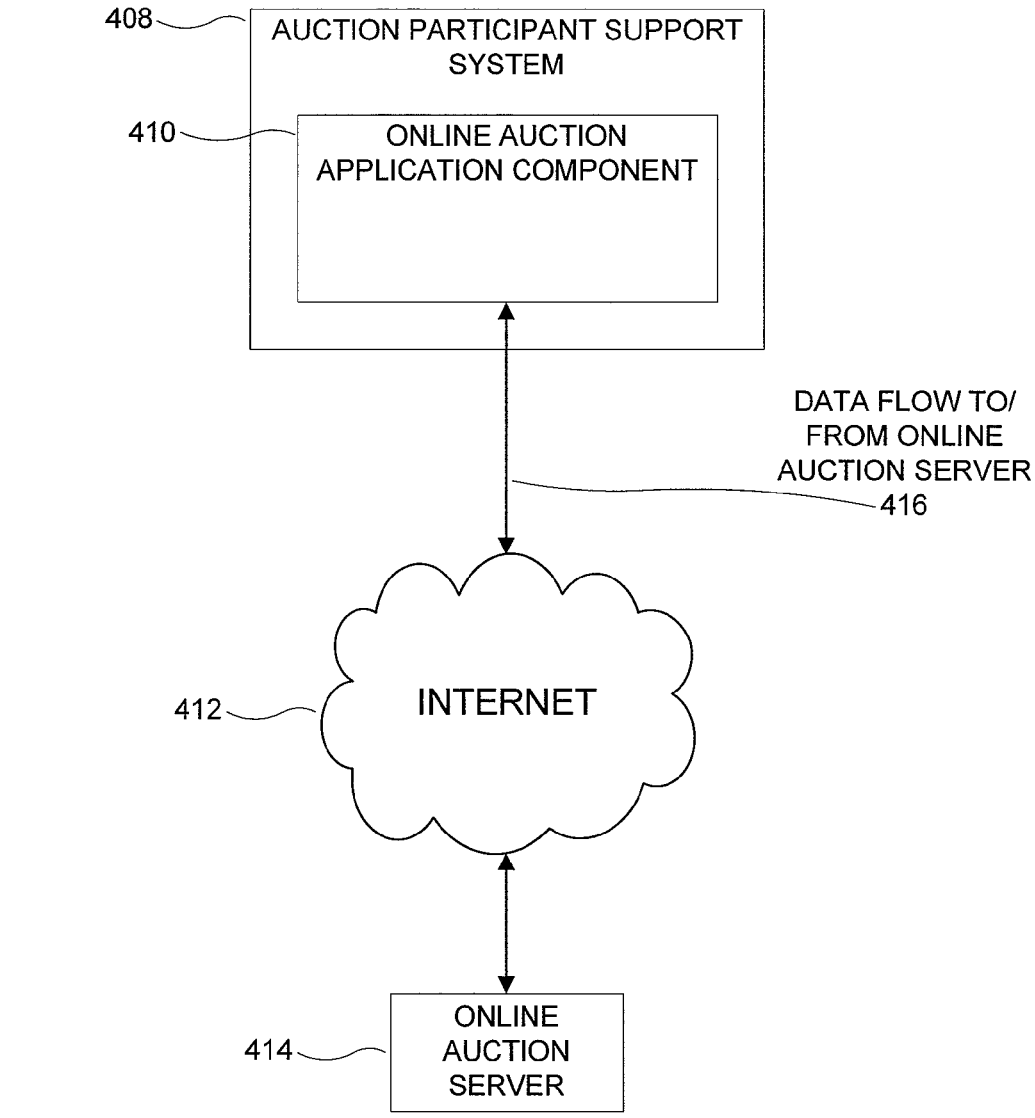

FIG. 4D is a schematic illustration 406 of data flow and the general data communication architecture for direct access of an online auction server 414 for an embodiment. The embodiment shown in FIG. 4D operates similarly to the embodiment described in the disclosure with respect to FIG. 4C above, except that the programmatic interface and any API provides for direct communication 416 from the online auction component 410 through the Internet 412 (or other networking technology) to/from the online auction server 414. While the technologies disclosed with respect to FIGS. 4A-D, alone, or in combination, discuss a wide variety of the possible data flow 416, other online auction servers may necessitate other implementations that may be used in an embodiment of the auction participant support system 408 by the online auction application component abstracting the data flow 416 implementation so that the user is provided seamless access to the online auction server 414.

In some situations, it may be possible to effectively create a "direct" link to the online auction server 414 via the interaction of a system user with the webpage of the online auction server 414, such as for use with a static/non-live auction (e.g., an eBay auction). To implement the "direct" link through the online auction server 414 webpage, a user may be permitted to navigate the online auction server 414 in the online auction application component 410 of the auction participant support system 408, rather than in a standalone web browser. When a webpage load event is detected in the online auction application component 410, the auction participant support system 408 may determine if the new webpage being loaded is an item details page, and, if the new webpage is an item details page, the contents of the newly loaded webpage may be parsed to extract the descriptive information about the auction item being viewed. Using the webpage of the online auction server 414 is beneficial to the online auction host(s) since using the webpage of the online auction server 414 permits inclusion without a need for additional programmatic interfaces to take care of the auction participant support system 408.

Figure 5:
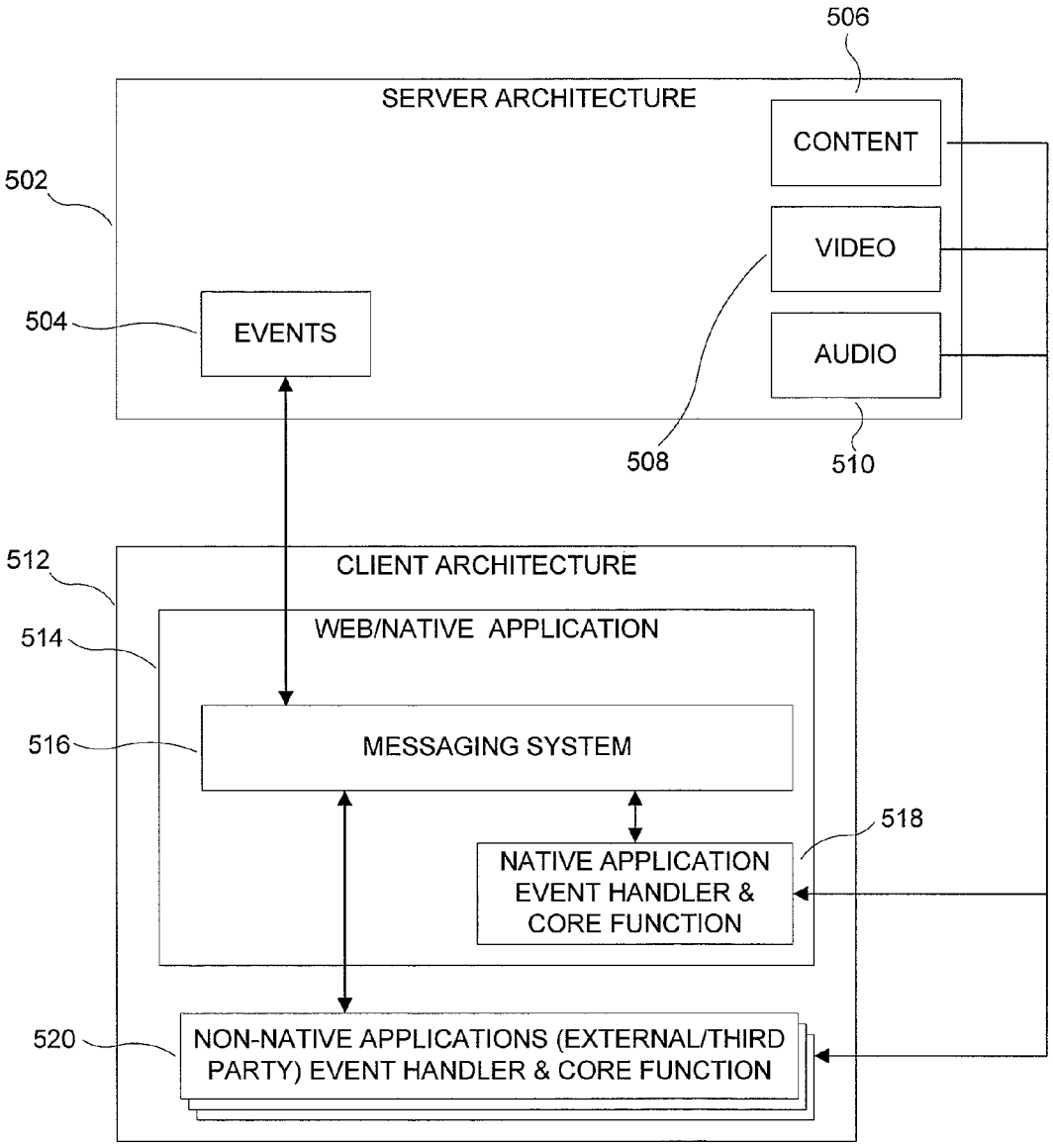
FIG. 5 is a schematic illustration of a typical client/server architecture for a web component enabled application component.

FIG. 5 is a schematic illustration 500 of a typical client 512/server 502 architecture for a web component enabled application component. Server side 502 functions 504-510 may include providing content 506, issuing/handling events 504, providing video (e.g., streaming video) 508, and/or providing audio (e.g., streaming audio) 510. Server side 502 functions 504-510 may be contained in one server 502 or multiple separate servers 502. The server 502 may be local (on the same computer system) or remote from the client 512. There may be one or multiple of each of the server side 502 functions 504-510. The content function 506 typically is a normal web server for handling typical web pages, images, etc. The event function 504 is the server side 502 push/messaging element. The video function 508 is typically handled by a video streaming server. The audio function 510 is typically handled by an audio streaming server. For some embodiments, the video 508 and/or audio 510 may only be made available to the web/native application event handler and core function 518 and not to the non-native applications 520 in order to minimize processing and system complexity.

The client architecture 512 typically provides the user interface to functions/features 504-510 provided by the server architecture 502. In the case of an online auction application, the client architecture 512 is the user interface provided to interact with the online auction application. Many client architectures 512 are implemented as rich Internet applications using technology such as Flash®, ActiveX™, and Applets. However, most other delivery technologies would also work including, but not limited to: downloadable applications, web only applications, or handheld applications. The client architecture 512 operates on a computer system that may, or may not, be the same computer system where the server architecture 502 operates. If the server architecture 502 operates on the same computer system as the client architecture 512, the server architecture 502 may be said to be local to the client architecture 512. If the server architecture 502 is on a separate computer system connected remotely via a network connection (e.g., the Internet) from the client architecture 512, the server architecture 502 may be said to be remote from the client architecture 512. The server architecture 502 may provide one or more instances of the various functions 504-510 locally and remotely at the same time such that the server architecture 502 is both local and remote depending on the specific server side function 504-510 in question.

The web/native application 514 operating within the client architecture 512 provides the core functionality 518 for a user of the functionality provided by the client 512 and server 502. For an online auction application, the web/native application may provide the functions for a user to participate in an auction such as buying, selling, managing the auction, and monitoring the auction. The web/native application 514 of an online auction application typically may display information about the current item/vehicle for sale as well as potentially providing audio 510 and/or video 508 streams of the online (and perhaps live) auction. The web/native application 514 is typically connected to a messaging system 516 that may relay events 504 to one or more client components 518, 520. The messaging system 516 may both receive events 504 from the server architecture 502 as well as issue events 504 to be handled by the server architecture 502. The web/native application 514 may incorporate a client component 518 that handles the events 504 and provides the core functionality of the web/native application based on the events 504 received. Similarly, one or more components 520 external to the web/native application 514 may also receive events 504 relayed from the messaging system 516. Thus, the client components 520 external to the web/native application 514 may "piggyback" on the message system 516 of the web/native application 514 to receive (and issue) events 504 such that additional load is not generated on the back-end event subsystem. The client components 520 external to the web/native application 514 may be created and/or maintained by a third party unrelated to the provider of the client architecture 512, server architecture 502, and/or web/native application 514.

Figure 6:
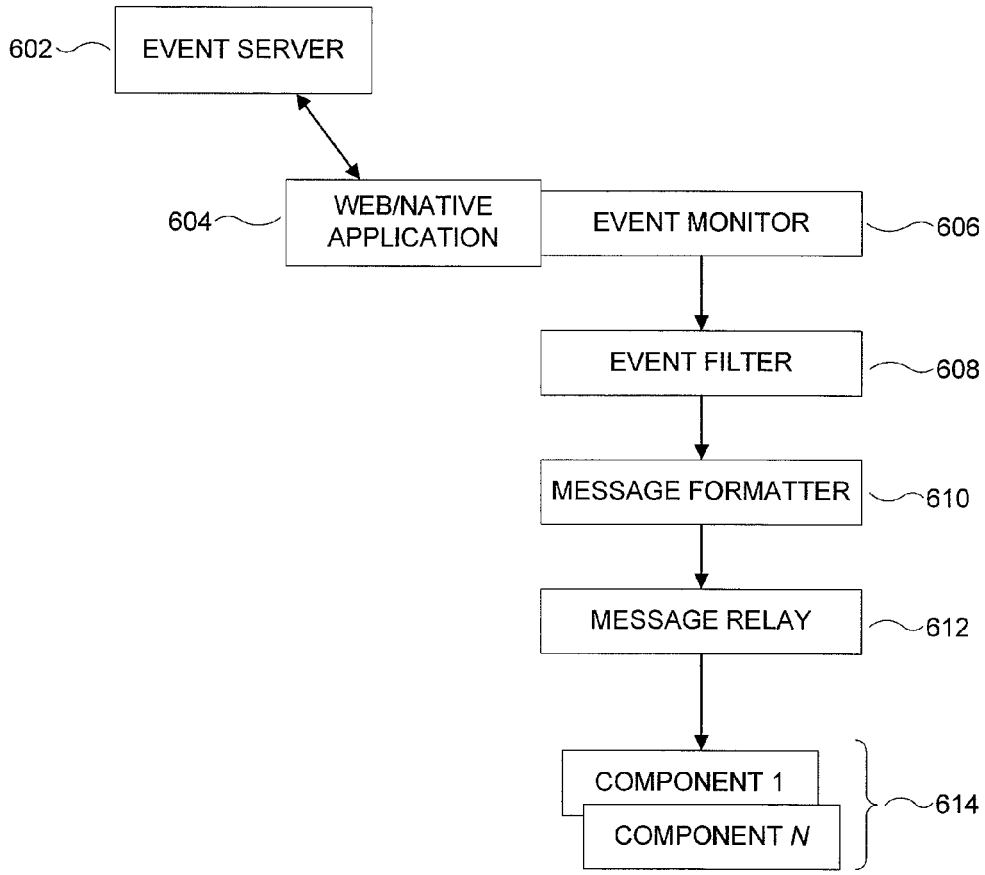
FIG. 6 is a schematic illustration of event handling for events delivered to isolated components of an embodiment.

FIG. 6 is a schematic illustration 600 of event handling for events delivered to isolated components 614 of an embodiment. In the embodiment shown in FIG. 6, the event server 602 pushes events to the web/native application 604. The web/native application may also push events back to the event server 602, which is typically less frequent, such as for sending a bid on an auction item. An embodiment may embed or attach an event monitor 606 into a web/native application 604, particularly for the web/native application 604 of the online auction application. While it may be possible to monitor all events with a single event monitor 606, it may be necessary to have multiple event monitors 606 embedded into/attached to a web/native application 604 in order to capture all relevant events. For the embodiment shown in FIG. 6, only a single event monitor 606 is shown, but various embodiments may perform similar functions with multiple event monitors 604 and/or multiple instances of the following chain 608-612 of supporting event handling elements. A Chain of Responsibility pattern may be used to reach the desired outcome and permit component re-use for different event monitors 606. The event monitor 606 composes the chain of commands to execute 608-612 in response to events and passes events through the chain of commands 608-612 as the events occur. The exact composition of the chain of commands 608-612 may vary by implementation. In one example, the event filter stops processing on events that are to be filtered (e.g., irrelevant and/or private events). The message formatter 610 may then convert the non-filtered event messages to an alternate format such as, but not limited to: Java™ to JavaScript™ Object, Java to JavaScript Object Notation (JSON), and/or Java to XML. The message formatter 610 may further provide field level filtering. For example, the message formatter 610 may broadcast that a seller changed a minimum acceptable bid, but hide the actual value of the minimum bid value. The message relay 612 may then broadcast the formatted event message to components 1 to N (614). In a publish and subscribe architecture, the components 614 would be subscribers.

Generally, the event monitor 606 passes each event through the event filter 608. The event filter 608 determines the type of the passed event and, based on a set of rules, determines if the event should be relayed to any subscribing third party components 614. Accordingly, the event filter 608 may suppress irrelevant and/or private event messages in order to avoid further processing on the irrelevant and/or private event messages. Relevant events pass through the event filter 608 to one or more message formatters 610. The message formatter(s) 610 may then convert the event message into an alternate format more compatible with subscribing components 614. For example, a message formatter 610 might convert a Java object in an Applet into a JavaScript object in the browser window context. The message formatter may also permit data suppression at the field level such as in the example given above for indicating a change in a minimum acceptable bid without passing the actual value of the minimum acceptable bid in the event message. The message formatter 610 passes the formatted event message to one or more message relays 612. The message relay(s) 612 then broadcast the formatted event message to one or more subscriber components 614. An embodiment of a message relay 612 may publish the formatted event messages using a Java Messaging Server. Embodiments may alternatively or additionally broadcast the formatted event messages to the web page containing the web/native application 604 and/or employ a Java to JavaScript bridge. Other event message broadcasting technologies known in the art may also be used by the message relay 612.

Figure 7:
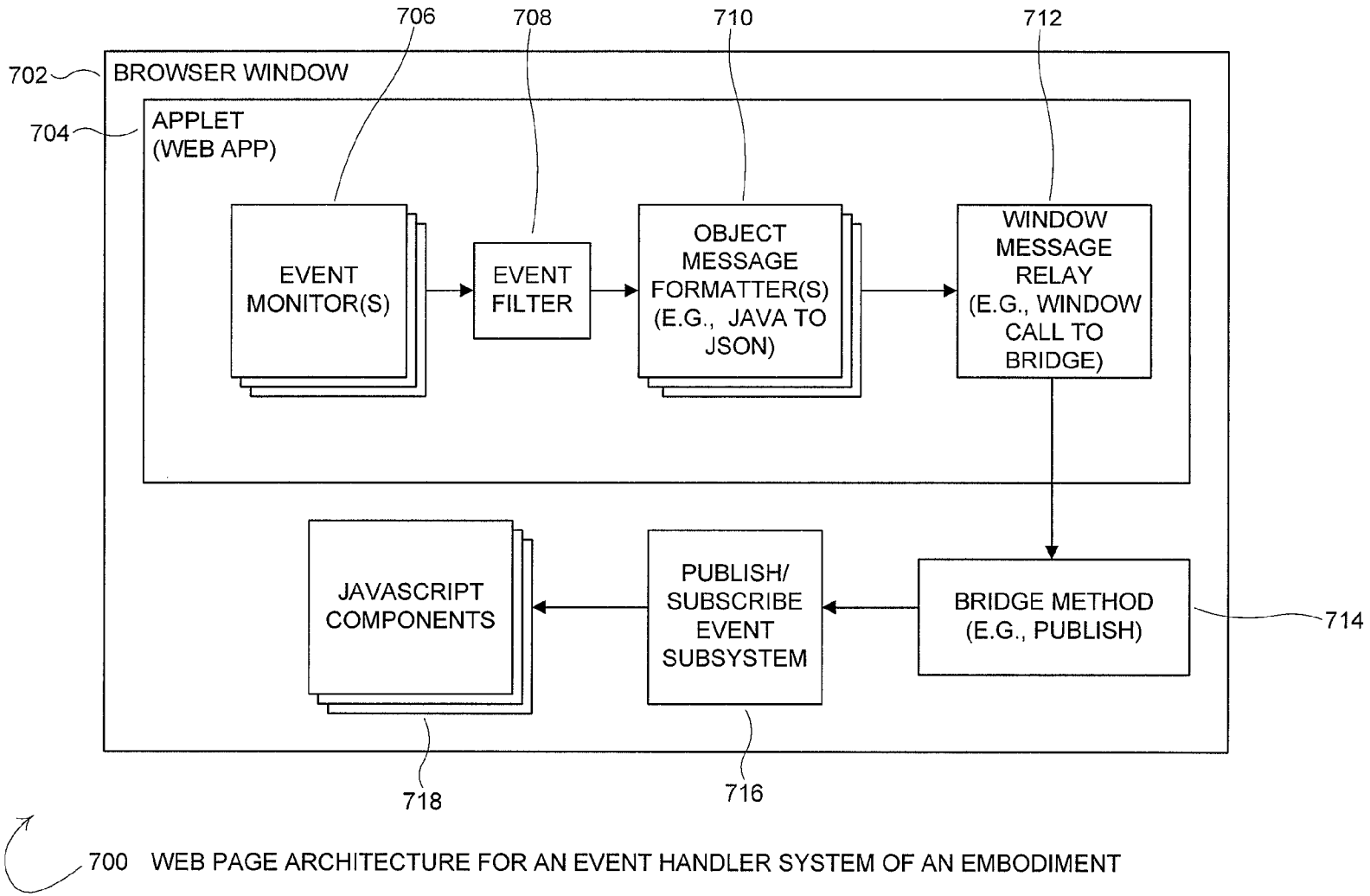
FIG. 7 is a schematic illustration of web page architecture for an event handler system of an embodiment.

FIG. 7 is a schematic illustration 700 of web page architecture for an event handler system of an embodiment. In the embodiment shown in FIG. 7, a browser window 702 contains an Applet 704. The Applet 704 has an event monitor(s) subsystem 706 that has/adds at least one event monitor 706 into a web/native application and also constructs a chain of commands to execute for a particular context (i.e., event). In the commands to execute, the Applet 704 executes an event filter subsystem 708 that determines the type of the passed event, and, based on a set of rules, determines if the event should be relayed to any subscribing third party components 718. After the event filter subsystem 708, the Applet executes at least one object message formatter subsystem 710. The object message formatter subsystem(s) 710 may retrieve the message from the passed context/event and convert the message to an alternate format. For example, an embodiment of the object message formatter subsystem 710 may convert the message to a JavaScript object for use in JavaScript components 718. Alternatively, an embodiment of a message formatter subsystem 710 may convert Java to JSON. In the commands to execute, the Applet 704 may further execute a window message relay subsystem 712. The window message relay subsystem 712 may retrieve the message and JavaScript object from the formatted passed context/event. The window event relay subsystem 712 may then invoke a bridge method 714, which then passes the formatted context/event and JavaScript object to the subscribed JavaScript components 718. In the embodiment shown in FIG. 7, the bridge uses a publish/subscribe event subsystem 716 to pass events to subscribing JavaScript components 718 in order to further filter events (i.e., if a JavaScript component 718 is not subscribed, the JavaScript component 718 will not receive the events from the publish/subscribe event subsystem 716). Further, each event may be handled as a separate thread to further ensure that the event does not interfere with the web/native application. Thus, events are processed and delivered to the subscribing JavaScript components 718 without interfering with and/or affecting operation of the web/native application.

Figure 8:
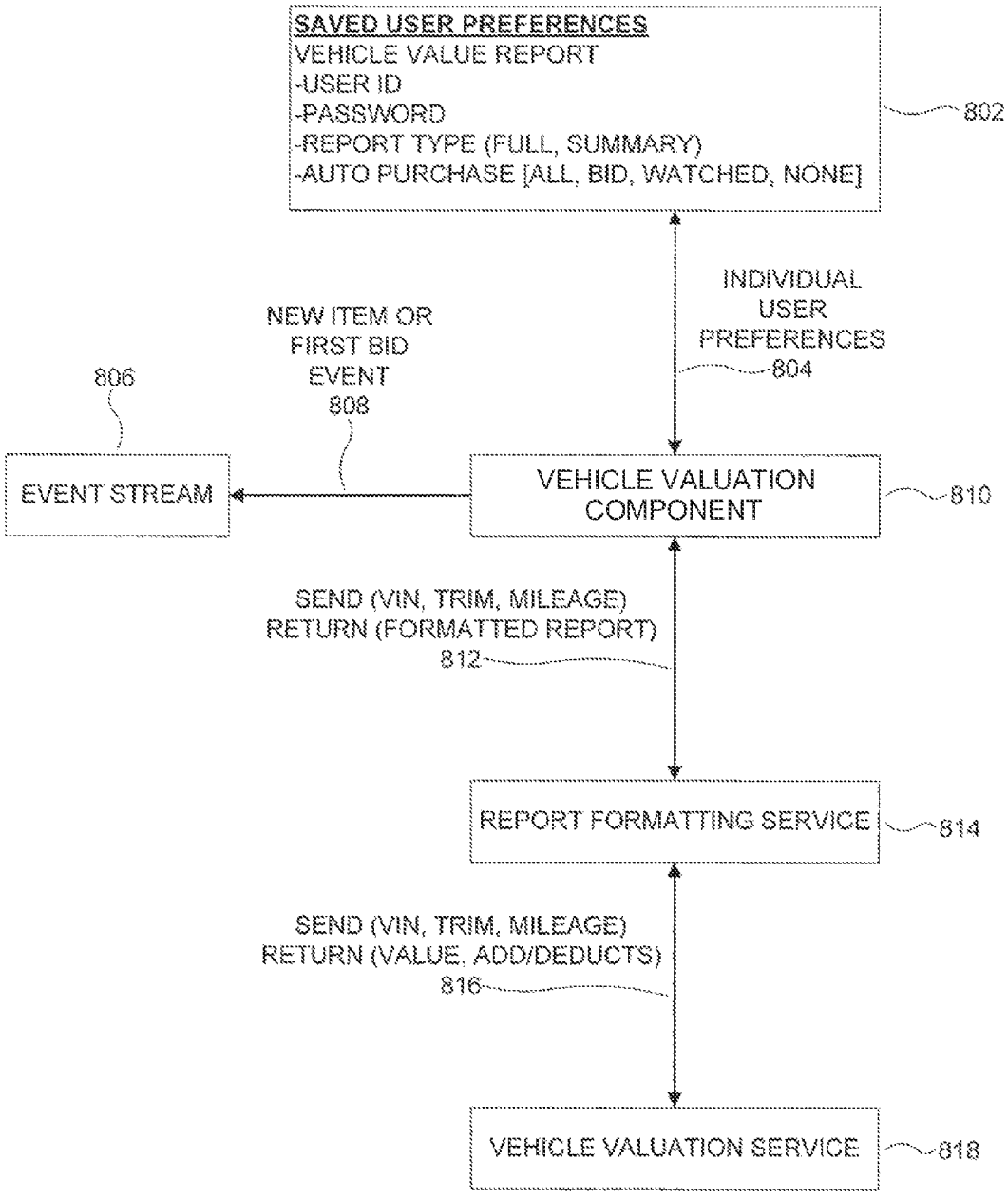
FIG. 8 is a schematic illustration of a vehicle valuation component integrated into an embodiment.

FIG. 8 is a schematic illustration 800 of a vehicle valuation component integrated into an embodiment. In the embodiment shown in FIG. 8, the vehicle valuation component 810 provides participants in an online auction with easy access to vehicle valuation information. Rather than requiring a user to copy and paste a VIN, mileage, or other identifying information, or to enter the VIN, mileage, or other identifying information manually into separate services, the vehicle valuation report may be requested and reported automatically based on the VIN, mileage, or other identifying information of the current vehicle being auctioned. The VIN of the current vehicle being auctioned is automatically reported to the vehicle valuation component 810 by capturing the appropriate new item event 808 in the event stream 806 and delivering the new item event 808 to the vehicle valuation component 810. The new item event 808 may identify the new vehicle up for auction with the VIN and/or the new item event 808 may also incorporate other identifying characteristics of the new vehicle such as, but not limited to: model, manufacturer, mileage, trim package, options, etc.

In the embodiment shown in FIG. 8, the vehicle valuation component 810 may be initialized by retrieving user preferences 804 from saved user preferences 802. Examples of saved preferences may include, but are not limited to: a user ID for the vehicle valuation service 818, a password for the vehicle valuation service 818, a desired report type (e.g., full or summary), and/or automatic purchase options (buy reports on all vehicles, only vehicles bid on, watched vehicles, or no vehicles). The user may also update and save user preferences 804 to the saved user preferences 802 from the vehicle valuation component 810. When a new item is put up for bid and the new item event 808 is delivered to the vehicle valuation component 810 from the event stream 806, the vehicle valuation component 810 may first clear the display to ensure that any old reports are not confused with reports for the new vehicle/item. Based on the user preferences and the identification information delivered with the new item event 808, the vehicle valuation component 810, acting as a client, may send current auction item identification information 812 such as the VIN, trim package, mileage, etc. to the report formatting service 814. The report formatting service 814 may pass the current auction item identification information (e.g., VIN, trim package, mileage, etc.) 816 to the vehicle valuation service 818. The vehicle valuation service 818 may then return the raw vehicle value and any additions/deductions 816 to the report formatting service 814. The report formatting service 814 may then format the raw vehicle value and additions/deductions 816 in accord with the saved user preferences 802. The formatted report 812 is returned to the vehicle valuation component 810, which displays the formatted vehicle valuation report 812 to the user in the single user interface window of an embodiment of the auction participant support system.

For some vehicle valuation services 818/report formatting services 814, each report may have an incremental monetary cost to the user. Thus, the user may want to exercise some control over when a vehicle valuation report is requested/purchased. If the user configured the vehicle valuation component 810 to purchase valuation reports for all vehicles, a valuation report request 812 may be made immediately after a new vehicle/item event 808 is delivered to the vehicle valuation component 810. If the user configured the vehicle valuation component 810 to purchase valuation reports for vehicles bid on by the user, a valuation report request 812 may be made immediately after a first bid event 808 for the current vehicle is delivered to the vehicle valuation component 810. Additional bid events 808 on the same vehicle may be filtered out of the event stream 806 for the vehicle valuation component 810 or simply ignored by the vehicle valuation component 810. If the user configured the vehicle valuation component 810 to purchase valuation reports for watched vehicles, a valuation report request 812 may be made immediately after a new vehicle/item event 808 for a watched vehicle is delivered to the vehicle valuation component 810. If the user configured the vehicle valuation component 810 to not automatically purchase valuation reports, a button may be displayed in the vehicle valuation component 810 permitting the user to request a valuation report for the currently auctioned vehicle by clicking on the request button in the vehicle valuation component 810. Additional reasons/filters for buying/not buying reports may be the single user interface window active/inactive states (i.e., a user may not want to purchase reports for an inactive/background window) and/or the minimized/not minimized status of the isolated component handling a report (i.e., a user may not want to purchase reports when the handling isolated component is minimized).

Various embodiments may provide the control and management functions detailed herein via an application operating on a computer system (or other electronic devices, including handheld devices). Embodiments may be provided as a computer program product which may include a computer-readable, or machine-readable, medium having stored thereon instructions which may be used to program/operate a computer (or other electronic devices) or computer system to perform a process or processes in accordance with the present invention. The computer-readable medium may include, but is not limited to, hard disk drives, floppy diskettes, optical disks, Compact Disc Read-Only Memories (CD-ROMs), Digital Versatile Disc ROMS (DVD-ROMs), Universal Serial Bus (USB) memory sticks, magneto-optical disks, ROMs, random access memories (RAMs), Erasable Programmable ROMs (EPROMs), Electrically Erasable Programmable ROMs (EEPROMs), magnetic optical cards, flash memory, or other types of media/machine-readable medium suitable for storing electronic instructions. The computer program instructions may reside and operate on a single computer/electronic device or various portions may be spread over multiple computers/devices that comprise a computer system. Moreover, embodiments may also be downloaded as a computer program product, wherein the program may be transferred from a remote computer to a requesting computer by way of data signals embodied in a carrier wave or other propagation medium via a communication link (e.g., a modem or network connection, including both wired/cabled and wireless connections).

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A method for integrating isolated components into an auction, comprising:

selecting a plurality of isolated components operating on a computer system by an auction participant support system operating on said computer system based on input from an auction participant's user-device, wherein at least one of said plurality of isolated components is an online auction application component that permits participation in an online auction, said online auction application component being directed to an online auction;

configuring, by the computer system, attributes and display of said plurality of isolated components for a single auction item within a single user interface window of said auction participant support system operating on said computer system based on input from an auction participant's user-device;

obtaining identification information from said online auction application component, the identification information being indicative of a current auction item that is currently being auctioned in said online auction;

communicating, by the auction participant support system operating on said computer system, said identification information to said plurality of isolated components except said online auction application component;

prompting, by the auction participant support system operating on said computer system, each of said plurality of isolated components to update in nearly real-time information for each of said plurality of isolated components, except said online auction application component, based on said identification information; and supplying, by the computer system, auction decision support information for said current auction item via said single user interface window, said auction decision support information is included in said updated information for said current auction item and is obtained from said plurality of isolated components.

2. The method of claim 1 further comprising:

monitoring, by said auction participant support system operating on said computer system, said online auction application component for changes in said current auction item;

detecting, by said auction participant support system operating on said computer system, that said current auction item has changed; and re-performing, by said auction participant support system operating on said computer system, steps of obtaining said identification information for said current auction item, communicating said identification information for said current auction item to said plurality of isolated components, prompting said plurality of independent components to update information based on said identification that identifies said current auction item, and supplying said updated information for said current auction item from said plurality of isolated components via said single user interface window.

3. The method of claim 1 further comprising:

generating, by said plurality of isolated components operating on said computer system, additional updates to said information for said current auction item for each of said plurality of isolated components; and supplying, by the computer system, said additional updates to said information for said current auction item via said single user interface window.

4. The method of claim 1 further comprising:

selecting and adding, by the computer system based on selection information received from said auction participant user, at least one additional isolated component to said plurality of isolated components; and re-configuring, by the computer system based on selection information received from the auction participant user, display of information obtained from said plurality of isolated components for a single auction item within said single user interface window to incorporate said at least one additional isolated component.

5. The method of claim 1 further comprising:

selecting and removing, by the computer system based on selection information received from said auction participant user, at least one isolated component from said plurality of isolated components; and re-configuring display of information obtained from said plurality of isolated components for a single auction item within said single user interface window by said auction participant user to incorporate removal of said at least one removed isolated component.

6. The method of claim 1 further comprising re-configuring at runtime display of information obtained from said plurality of isolated components for a single auction item within said single user interface window by said auction participant user to change to a desired new display configuration.

7. The method of claim 1 further comprising at least one of said plurality of isolated components obtaining said information for said current auction item by instructing a remote server application operating on a separate computer system over a network connection to deliver said information for said current auction item over said network connection to said at least one of said plurality of isolated components.

8. The method of claim 1 further comprising delivering commands from said auction participant support system operating on said computer system to at least one of said plurality of isolated components operating on said computer system based on interaction of said auction participant user with said single user interface window.

9. The method of claim 1 wherein said online auction comprises an automobile auction, a farm equipment auction, a construction equipment auction, a recreational vehicle auction, a motorcycle auction, an all-terrain vehicle auction, a motorized vehicle auction, a boat auction, an airplane auction, a motorized equipment auction, an industrial equipment auction, a cattle auction, a horse auction, a livestock auction, an art auction, a general merchandise auction, a live auction, a static auction, or a non-live auction.

10. The method of claim 1 wherein said identification information is comprises at least one of Vehicle Identification Number (VIN); make; manufacturer; model; sub-model; trim package; model year; manufacture/build date; engine size; mileage; included equipment/options; operational hours; location; acreage; number of buildings; building descriptions; age; breed; sex; artist; options added; or options removed.

11. The method of claim 1 further comprising re-performing said steps of claim 1 at least a second time with said online auction application component directed to an additional online auction, said additional online auction occurring substantially concurrently with said first online auction, and said step of displaying said updated information for said current auction item in said additional online auction displays said updated information for said current auction item in said additional online auction in an additional single user interface window for said additional online auction.

12. The method of claim 1 further comprising notifying, by said auction participant support system operating on said computer system, said auction participant user of said auction participant support system by said auction participant support system operating on said computer system of actions relating to a status of said online auction.

13. The method of claim 12 wherein said notification is performed while said single user interface window is operating as a background task on said computer system, wherein said single user interface window is not a primary window actively selected by said auction participant user on said computer system.

14. The method of claim 12 wherein said notification comprises at least one of an auditory cue or a visual cue.

15. The method of claim 12 wherein said actions of said online auction comprise at least one of start of an auction for a new current auction item, end of an auction for said current item, a new bid received for said current auction item, a new asking price is received for said current auction item, said current auction item is sold, said current auction item is sold conditionally, a no-sale of said current auction item, or a specifically desired auction item on a watch list is brought up for auction.

16. The method of claim 12 wherein said at least one of said plurality of isolated components performs said notifying of said auction participant user of said actions of said status of said online auction.

17. The method of claim 1 further comprising performing non-decision support tasks by said auction participant support system operating in response to actions taken during said online auction.

18. The method of claim 17 wherein said non-decision support tasks comprise at least one of: importing purchased items including a new inventory item within an inventory system accessible by said computer system, requesting delivery of said purchased items in accord with preferences of said auction participant user, requesting a post-sale inspection of said purchased items, or requesting financing to complete a purchase of said purchased items.

19. The method of claim 1 wherein said auction participant support system interaction with said online auction application component is configured to not affect operation of an online auction application that provides data to said online auction application component.

20. The method of claim 1 further comprising:

monitoring said online auction application component for actions occurring in said online auction by said auction participant support system operating on said computer system;

delivering action information regarding said actions from said auction participant support system to said plurality of isolated components except said online auction application component;

prompting each of said plurality of isolated components to update information for each of said plurality of isolated components based on said action information; and displaying said updated information based on said action information in said single user interface window.

21. The method of claim 20 further comprising filtering to update information for specified actions by each of said isolated components, wherein each of said isolated components updates information for said specified actions and does not update information for unspecified actions that are not specified, said specified actions being configured to prompt updating of information.

22. The method of claim 20 wherein said actions of said online auction comprise at least one of a start of an auction for a new current auction item, an end of an auction for said current item, reception of a new bid for said current auction item, reception of a new asking price for said current auction item, sale of said current auction item, conditional sale of said current auction item, a no-sale of said current auction item, and placement for auction of a specifically desired auction item on a watch list.

23. The method of claim 1 wherein at least one of said plurality of isolated components further comprises:

obtaining additional item information about said current auction item by at least one additional item information gatherer component, said additional item information gatherer component being one of said plurality of isolated components; and delivering at least a portion of said additional item information about said current auction item from said at least one additional information component to at least one other component of said plurality of isolated components, wherein said at least one other isolated component updates information based on said identification information and said at least a portion of said additional item information.

24. The method of claim 1 further comprising stopping unnecessary data retrieval in said isolated components when said single user interface window is operating as a background task on said computer system, wherein said single user interface window is not a primary window actively selected by said auction participant user on said computer system.

25. The method of claim 1 wherein communication between said isolated components operating on said computer system and said auction participant support system operating on said computer system is accomplished by said auction participant support system and said isolated components issuing event messages and listening for said event messages in order to react to appropriate events.

26. The method of claim 25 further comprising filtering events at said isolated components and said auction participant support system, wherein said isolated components and said auction participant support system perform actions in response to said event messages of desired event message types and dismiss said event messages of undesired event message types.

27. The method of claim 26 wherein said event messages are restricted by a publish and subscribe mechanism, wherein said isolated components and said auction participant support system subscribe to event message outputs from said auction participant support system and other isolated components.

28. A system comprising:

a computer-readable non-transitory storage medium having instructions encoded thereon, the instructions comprising a component selection subsystem, a component configuration subsystem, a current auction item identification subsystem, an update component subsystem, and a user interface subsystem; and a computer system that is coupled to the computer-readable non-transitory storage medium and is configured to execute the instructions, wherein:

the component selection subsystem is configured to select a plurality of isolated components operating on said computer system at direction of an auction participant user where at least one of said plurality of isolated components is an online auction application component that permits participation in an online auction, said online auction application component being directed to an online auction;

the component configuration subsystem is configured to configure attributes and display of said plurality of isolated components for a single auction item within a single user interface window at direction of said auction participant user;

the current auction item identification subsystem is configured to obtain identification information from said online auction application component, said identification information identifies a current auction item that is currently being auctioned in said online auction, and deliver said identification information that identifies said current auction item being auctioned to said plurality of isolated components except said online auction application component;

the update component subsystem is configured to prompt each of said plurality of isolated components to update in nearly real-time information for each of said plurality of isolated components except said online auction application component based on said identification information that identifies said current auction item being auctioned; and the user interface subsystem is configured to display said updated information for said current auction item from said plurality of isolated components in said single user interface window where said auction participant user obtains auction decision support information for said current auction item from said plurality of isolated components in said single interface window.

29. The system of claim 28 further comprising an auction change monitoring subsystem configured to monitor said online auction application component for changes in said current auction item and when said auction change monitoring subsystem detects that said current auction item has changed is configured to cause re-performance of said current auction item identification subsystem, said update component subsystem, and said user interface subsystem.

30. The system of claim 28 wherein generation by said plurality of isolated components of additional updates to said information for said current auction item for each of said plurality of isolated components causes said user interface subsystem to display said additional updates to said information generated by said plurality of isolated components for said current auction item in said single user interface window.

31. The system of claim 28 wherein said user interface subsystem is further configured to re-configure at runtime display of information obtained from said plurality of isolated components for a single auction item within a single user interface window in accord with said auction participant user input to change to a new display configuration desired by said auction participant user.

32. The system of claim 28 wherein said system operates at least a second time with said online auction application component directed to an additional online auction, said additional online auction occurring substantially concurrently with said first online auction, and said user interface subsystem is further configured to display said updated information for said current auction item in said additional online auction in an additional single user interface window for said additional online auction.

33. The system of claim 28 further comprising a non-decision support task subsystem that performs non-decision support tasks in response to actions taken during said online auction.

34. The system of claim 28 further comprising an auction change monitoring subsystem configured to:

monitor said online auction application component for actions occurring in said online auction, deliver action information regarding said actions occurring in said online auction from said system to said plurality of isolated components except said online auction application component, prompt each of said plurality of isolated components to update information for each of said plurality of isolated components based on said action information, and cause said user interface subsystem to display said updated information based on said action information in said single user interface window.

35. The system of claim 34 wherein said auction change monitoring subsystem is further configured to filter to update information for specified actions by each of said isolated components where each of said isolated components updates information for said specified actions and does not update information for actions that are not specified, said specified actions being actions specified by a designer of each of said isolated components as actions that prompt updating of information.

36. The system of claim 28 wherein at least one of said plurality of isolated components further obtains additional item information about said current auction item by at least one additional item information gatherer component, said additional item information gatherer component being one of said plurality of isolated components, and delivers at least a portion of said additional item information about said current auction item from said at least one additional information component to at least one other component of said plurality of isolated components where said at least one other isolated component updates information based on said identification information and said at least a portion of said additional item information.

* * * * *